US008827528B2

(12) United States Patent
Takeda et al.

(10) Patent No.: US 8,827,528 B2
(45) Date of Patent: Sep. 9, 2014

(54) KEY SHEET, LIGHTPROOF LIGHT GUIDING SHEET, PUSHBUTTON SWITCH, AND METHOD OF MANUFACTURING KEY SHEET

(75) Inventors: Yasunori Takeda, Tokyo (JP); Hiroki Kishiku, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 392 days.

(21) Appl. No.: 13/133,730

(22) PCT Filed: Sep. 15, 2009

(86) PCT No.: PCT/JP2009/066109

§ 371 (c)(1),
(2), (4) Date: Aug. 5, 2011

(87) PCT Pub. No.: WO2010/070956

PCT Pub. Date: Jun. 24, 2010

(65) Prior Publication Data

US 2011/0278145 A1 Nov. 17, 2011

(30) Foreign Application Priority Data

Dec. 16, 2008 (JP) ..... 2008-320179

(51) Int. Cl.
*H01H 9/00* (2006.01)
*H01H 13/83* (2006.01)

(52) U.S. Cl.
CPC ..... *H01H 13/83* (2013.01)
USPC ..... 362/615; 362/618; 362/619; 200/314; 200/341

(58) Field of Classification Search
CPC ..... H01H 13/83
USPC ..... 362/615, 26, 607–609, 619; 361/679.54, 679.46, 704–706; 200/5, 200/314, 341–345, 512
See application file for complete search history.

(56) References Cited

U.S. PATENT DOCUMENTS

2006/0254894 A1 11/2006 Jung et al.
2009/0050456 A1 2/2009 Kim et al.
2009/0322568 A1* 12/2009 Yoshida ..... 341/22

FOREIGN PATENT DOCUMENTS

JP 06-347792 A 12/1994
JP 07-028057 A 1/1995

(Continued)

OTHER PUBLICATIONS

Front Page of Office Action from Chinese Patent App. No. 200980149930.0 (May 22, 2013).

(Continued)

*Primary Examiner* — Elmito Breval
(74) *Attorney, Agent, or Firm* — Cermak Nakajima LLP; Tomoko Nakajima

(57) ABSTRACT

The present invention provides technology that can efficiently guide light to the interior of a key sheet and prevents light from leaking from the circumferences of key tops. A key sheet has a light-shielding dark print layer, on the rear surface of a base sheet, that is a cured body of a coating liquid that is not dissolve to the surface of the base sheet, and also has a smooth surface between the base sheet and the dark print layer. The invention can make light transmitting in the base sheet hard to enter the dark print layer so that the light can be efficiently guided in the base sheet, and also can prevent light from transmitting through the base sheet by blocking the light.

20 Claims, 12 Drawing Sheets

(56) References Cited

FOREIGN PATENT DOCUMENTS

| | | | |
|---|---|---|---|
| JP | 09-183920 | A | 7/1997 |
| JP | 2003-281920 | A | 10/2003 |
| JP | 2004-338379 | A | 12/2004 |
| JP | 2006-318905 | A | 11/2006 |
| JP | 2008-041431 | A | 2/2008 |
| JP | 2008-060058 | A | 3/2008 |
| JP | 3140583 | U | 3/2008 |
| JP | 2008-140766 | A | 6/2008 |
| JP | 2008-226613 | A | 9/2008 |
| JP | 2008-537311 | A | 9/2008 |
| TW | 200737254 | A | 10/2007 |

OTHER PUBLICATIONS

International Search Report for PCT Patent App. No. PCT/JP2009/066109 (Dec. 28, 2009).

Office Action for Japanese Patent App. No. 2010-542903 (Jul. 16, 2013).

Office Action from Japanese Patent App. No. 2010-542903 (Nov. 29, 2013).

* cited by examiner

KEY SHEET, LIGHTPROOF LIGHT GUIDING SHEET, PUSHBUTTON SWITCH, AND METHOD OF MANUFACTURING KEY SHEET

This application is a national phase entry under 35 U.S.C. §371 of PCT Patent Application No. PCT/JP2009/066109, filed on Sep. 15, 2009, which claims priority under 35U.S.C. §119 to Japanese Patent Application No. 2008-320179, filed Dec. 16, 2008, both of which are incorporated by reference.

TECHNICAL FIELD

The present invention relates to a key sheet from which a superior pressing operation feeling is obtained as a key sheet for a push-button switch used to supply inputs to mobile information terminals such as mobile phones, PDAs, and mobile music players and to various types of electronic devices such as AV devices. The present invention particularly relates to an illumination type of key sheet, a lightproof light guiding sheet used in the key sheet, a push-button switch having the key sheet, and the method of manufacturing the key sheet.

BACKGROUND ART

In general, push-button switches on various types of electronic devices such as mobile information terminals and AV devices are structured by covering a key sheet having push-button switches (key tops) on a circuit board on which contact switches are placed. To enhance operability in a dark place, backlighting is used in which light from internal light sources provided on the back of the key sheet are used to brightly illuminate the key sheet.

As an example of this type of illuminated push-button switches, Japanese Unexamined Patent Application Publication No. 2008-140766 describes a structure in which a light-guiding sheet (light guide) is provided between a circuit board on which contact switches (metal domes) are placed and a key sheet having key tops and a base sheet (elastic sheet). If a light-guiding sheet is provided like this, light can be passed through the interior of the light-guiding sheet and can be transmitted over the entire key sheet.

However, the structure described in Patent Document 1 is problematic in that, for example, each push-button switch is thickened by an amount equal to the thickness of the light-guiding sheet, the number of parts is increased, and the light-guiding sheet disposed between the contact switches and the key sheet reduces click feelings and thereby impairs the operation feeling. Accordingly, an improved structure is proposed in which a highly transparent resin film is used as the base sheet so that the base sheet also has an effect as the light-guiding sheet, enabling the operation feeling to be less likely to be impaired without the push-button switch thickness and the number of parts being increased.

Patent Document 1: Japanese Unexamined Patent Application Publication No. 2008-140766

DISCLOSURE OF INVENTION

Problems to be Solved by the Invention

With illuminated push-button switches, a dark print layer may be provided on the base sheet so as to cover the clearance among the key tops, in order to prevent light emitted from the internal light sources from leaking from the circumferences of the key tops. If this type of dark print layer is used in the improved structured described above, the dark print layer has to be disposed on a surface of the base sheet formed of a highly transparent resin film. This causes another problem in that the dark print layer absorbs light transmitting in the base sheet and the illumination brightness of the push-button switch is thereby lowered. If the light-guiding sheet is combined with the push-button switch, another problem is caused in that the rigidity of the light-guiding sheet increases the pressing load and the operation feeling is thereby impaired.

The present invention addresses the above problems in the prior art. That is, an object of the present invention is to provide technology that prevents light from easily leaking from the circumferences of the key tops without the illumination brightness of the push-button switch being lowered. Another object of the present invention is to provide technology from which a superior pressing operation feeling is obtained.

Means for Solving the Problems

To achieve the above objects, the present invention is structured as described below.

For an illuminatable key sheet having a base sheet formed of a transparent resin film and depressing operation portions disposed on an operation surface side of the base sheet, a key sheet is provided that is characterized in that the base sheet is a light-guiding sheet, a transparent resin layer is formed on the surface of at least one side of the base sheet, a dark print layer, which shields light, is formed on a surface of the transparent resin layer, and a smooth surface is provided between the base sheet and the dark print layer.

To make a key sheet illuminatable, internal light sources such as LEDs are generally provided inside a device in which the key sheet is mounted. Usually, the internal light sources are disposed at the bottom of the key sheet to illuminate the key sheet. Since the base sheet is a type of light-guiding sheet, light can be directed from an end of the base sheet into the interior of the base sheet to illuminate the key sheet, and the internal light sources can be disposed at the ends of the key sheet instead of its bottom. Accordingly, the spacing between the key sheet and the circuit board on which the internal light sources are disposed can be narrowed, enabling the device to be thinned.

In addition, since the dark print layer, which shields light, is formed on the surface of at least one side of the base sheet with the transparent resin layer intervening therebetween, it is possible to prevent light from transmitting through the base sheet and then leaking to the outside. Light emitted from the internal light source is not totally directed to the base sheet, but part of the light is directed to the spacing between the key sheet and the circuit board. The light directed like this may be diffusely reflected in the interior of the device, may transmit in the thickness direction of the base sheet, and may exit from the spacings among the depressing operation portions. The light exiting from the spacings among the depressing operation portions causes light leakage from the device. If the dark print layer, which shields light, is formed on the surface of at least one side of the base sheet, however, the diffusely reflected light cannot be transmitted through the key sheet, preventing the light leakage.

In addition, a smooth surface is provided between the base sheet and the dark print layer. That is, at least one of the interface between the base sheet and the transparent resin layer and the interface between the transparent resin layer and the dark print layer is a smooth surface. In other words, at least one of the surface of the transparent resin layer that faces the base sheet or the surface of the base sheet that faces the transparent resin layer, and the surface of the dark print layer that faces the transparent resin layer or the surface of the transparent resin layer that faces the dark print layer is a smoothing surface. This smooth surface enables light to be almost totally reflected without being diffused, so the light transmitting in the base sheet can be made hard to enter the dark print layer. Then, the amount of light absorbed by the dark print layer can be reduced. Accordingly, even when the dark print layer is added to the base sheet, the light transmitting in the base sheet cannot be easily absorbed by the dark print layer, and a decrease in the illumination brightness can be thereby reduced.

The transparent resin layer can be made of a resin having a lower refractive index than that of the base sheet. Then, the light transmitting in the base sheet can be totally reflected on the interface between the base sheet and the transparent resin layer toward the interior of the base sheet. This can make the light transmitting in the base sheet hard to enter the dark print layer. Light absorption by the dark print layer can be lessened in this way, and thereby even when the dark print layer is added to the base sheet, the light transmitting in the base sheet cannot be easily absorbed by the dark print layer, and a decrease in the illumination brightness can be reduced.

The difference in refractive index between the transparent resin layer and the base sheet can take a value of 0.06 or more. Thus, the light transmitting in the base sheet can be totally reflected efficiently on the interface between the base sheet and the transparent resin layer toward the interior of the base sheet. This can make the light transmitting in the base sheet hard to enter the dark print layer, and light absorption by the dark print layer can be lessened. Thus, even when the dark print layer is added to the base sheet, the light transmitting in the base sheet cannot be easily absorbed by the dark print layer and a decrease in the illumination brightness can be reduced.

The transparent resin film that forms the base sheet preferably has rubber elasticity. If the base sheet has rubber elasticity, when the key sheet is pressed, the base sheet can be easily deformed, and a superior pressing operation feeling can be thereby obtained without having to increase the pressing load. Furthermore, rubber elasticity not only easily causes deformation with a low load but also produces a restoring force due to stress generated during deformation. Accordingly, if the base sheet has rubber elasticity, it enables input operation to be easily performed during a press input, without the need to increase the pressing load; after the press input, stress generated due to the warp deformation of the base sheet during the press input is exerted as the restoration force of the base sheet, by which the base sheet is restored to the state before the pressing operation, enabling the pressing operability to be improved and also enabling a superior pressing operation feeling to be obtained.

The base sheet can have rubber elasticity equivalent to a rubber hardness of A50 to A90 stipulated in JIS K6253. Then, when the key sheet is pressed, the base sheet can be appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

The transparent resin layer can be made of a cured body of a coating liquid that is not dissolve to the surface of the base sheet. Since the transparent resin layer is made of a cured body of a coating liquid that is not dissolve to the surface of the base sheet, the surface of the base sheet can be kept smooth, without the surface being made rough due to the formation of the transparent resin layer. Even if a dark print layer made of a solvent-type coating liquid that is dissolve to the surface of the transparent resin layer is formed, since the surface of the base sheet that faces the transparent resin layer is smooth, a smooth surface can be provided between the base sheet and the dark print layer, making the light transmitting in the base sheet hard to enter the dark print layer.

If an erosive solvent-type coating liquid is applied to the base sheet, the surface of the base sheet is dissolved, so the interface between the base sheet and the transparent resin layer cannot be kept smooth. If a non-erosive coating liquid is applied, however, the interface between the base sheet and the transparent resin layer, that is, in this case, both the surface of the transparent resin layer that faces the base sheet and the surface of the base sheet that faces the transparent resin layer, can be kept smooth.

More specifically, the transparent resin layer can be made of a cured body of a non-solvent-type coating liquid, an aqueous-based solvent-type coating liquid, or an alcohol-based solvent-type coating liquid that is not dissolve to the surface of the base sheet. If the transparent resin layer is made of a cured body of a non-solvent-type coating liquid, such as an ultraviolet-curable type or thermosetting type coating liquid, that is not dissolve to the surface of the base sheet or with a cured body of a non-erosive aqueous-based or alcohol-based solvent-type coating liquid, the surface of the base sheet can be kept smooth. These coating liquids are preferably cured bodies of ultraviolet-curable type, thermosetting type, or the like.

Furthermore, the transparent resin layer can be made of a cured body of an ultraviolet-curable urethane acrylate-based ink or a cured body of a thermosetting urethane ink. Since the transparent resin layer was made of a cured body of an ultraviolet-curable urethane acrylate-based ink or a cured body of a thermosetting urethane ink, the base sheet surface can be kept smooth without being dissolved. In addition, the surface of the transparent resin layer can be smooth.

The surface of the base sheet that faces the transparent resin layer can be made smooth. Since the surface of the base sheet that faces the transparent resin layer was made smooth, the light transmitting in the base sheet can be made hard to enter the dark print layer. Accordingly, light leakage from the interior of the base sheet can be made hard to occur and the amount of light guided in the base sheet can be made hard to drop.

A dark print layer that dissolves the transparent resin layer can also be used, widening the range of coating liquids selectable for the dark print layer. This is because the interface between the base sheet and the transparent resin layer is already made smooth and light can be thereby efficiently guided in the base sheet even if the interface between the transparent resin layer and the dark print layer is rough.

The dark print layer can be made of a cured body of a coating liquid that is not dissolve to the surface of the transparent resin layer. Then, the interface between the transparent resin layer and the dark print layer, that is, both the surface of the dark print layer that faces the transparent resin layer and the surface of the transparent resin layer that faces the dark print layer can be made smooth, without the transparent resin layer being dissolved during the coating of the dark print layer.

The surface of the transparent resin layer that faces the dark print layer can be made smooth. Then, although the light transmitting in the base sheet may enter the transparent resin layer, the light can be made hard to enter the dark print layer. This can prevent the dark print layer from absorbing the light.

The transparent resin layer can be disposed over the entire surface of at least one side of the base sheet. Then, a smooth surface covering the entire surface of the base sheet can be formed by the transparent resin layer, making light hard to leak over the entire base sheet surface on which the transparent resin layer is formed.

Diffusing parts can be formed on the surface of at least one side of the base sheet to direct the light transmitting in the surface directions of the base sheet to the depressing operation portions, the surface of the base sheet that face the diffusing parts being made rough.

Since the diffusing parts of this type were formed, the light transmitting in the surface directions of the base sheet can be diffused by the diffusing parts to illuminate the depressing operation portions. The diffusing parts can be distributed in a dot pattern. If the diffusing parts are distributed in a dot pattern, illumination brightness can be adjusted for each push-button switch by appropriately adjusting the size and shape of each diffusing part and the spacings among diffusing parts.

The diffusing part is formed by, for example, printing a resin ink to which a filling material having a high refractive index, a filling material having a high light reflection coefficient, or the like has been added. In general, the base sheet surface to which the diffusing parts are fixed is made rough by eroding the surface during the formation of the diffusing parts, so the depressing operation portions can be illuminated with light exiting from the base sheet through the diffusing parts.

In the structure in the present invention in which a smooth surface is provided between the base sheet and the dark print layer, the diffusing parts of this type can particularly efficiently transmit light to the depressing operation portions.

The distribution of the diffusing parts can be shaped so as to form a display element. In prior art, a character, a symbol, or another display element printed on each depressing operation portion is illuminated with back light and differences in the amount of transmitting light and in color tones among the display elements are used so that the display elements can be visually recognized with ease. By contrast, since the distribution shape of the diffusing parts was used to form a display element, the display element can be visually recognized without having to forming the display element separately on the depressing operation portion. Unlike the display element formed on a printed layer, the display element formed by the diffusing parts can achieve new design in which emitted light itself forms a display element.

The diffusing parts can be formed so as to be covered by the transparent resin layer. Since the transparent resin layer can cover the diffusing parts, contacts between the diffusing parts and the dark print layer can be avoided, and thereby light reflected on the diffusing parts can be made hard to enter the dark print layer.

Light can be guided from an outer edge of the base sheet, which extends to an outer edge of the key sheet, into the interior of the base sheet in its surface directions. Then, internal light sources such as LEDs can be disposed at ends of the key sheet, enabling the spacing between the key sheet and the circuit board on which the internal light sources are disposed to be narrowed. In comparison with a case in which light is guided from the base sheet surface, light parallel to the direction in which the light is guided can be guided. Since such light can be efficiently reflected in the light-guiding sheet, bright illumination is possible to a further area.

Pushers can be formed on the surface of the dark print layer that is disposed opposite to the depressing operation portions with the base sheet intervening therebetween. Then, a superior pressing operation feeling can be obtained and the contact switches on the circuit board can be reliably pressed with the pushers, resulting in accurate press inputs. Since, with respect to the base sheet, each pusher is disposed across the dark print layer, it is not possible that light guided in the base sheet is reflected on a side of the pusher and is thereby visually recognized. In addition, it is not also possible that light that has been directly incident on the pusher from the outside of the key sheet is reflected on a side of the pusher and is thereby visually recognized. That is, the depressing operation portion side is illuminated with light reflected on the diffusing parts and illumination with unintended light such as light reflected on the sides of the pushers can be suppressed.

The present invention further provides a lightproof light guiding sheet in which the transparent resin layer is formed on the surface of at least one side of the light-guiding sheet, the dark print layer, which shields light, is further formed on the surface of the transparent resin layer, and a smooth surface is provided between the light-guiding sheet and the dark print layer.

With the lightproof light guiding sheet, the dark print layer, which shields light, was formed on the surface of at least one side of the light-guiding sheet across the transparent resin layer. This can prevent light directed from the outside of the light-guiding sheet from transmitting in the light-guiding sheet in its thickness direction and exiting to the opposite surface. Accordingly, the light-guiding sheet can be used as the base sheet of an illuminatable key sheet.

Since a smooth surface is provided between the base sheet and the dark print layer, the light transmitting in the base sheet can be made hard to enter the dark print layer. Accordingly, almost all light can be reflected in the lightproof light guiding sheet and can be transmitted in its surface directions, without the light being diffused to the outside of the lightproof light guiding sheet.

As for the lightproof light guiding sheet, if the transparent resin layer is formed from a cured body of a coating liquid that is not dissolve to the surface of the base sheet, the risk that the base sheet surface is dissolved is lessened. This transparent resin layer can be formed by applying a non-solvent-type coating liquid or an aqueous-based or alcohol-based non-dissolve solvent-type coating liquid to the surface of the base sheet and curing the coating liquid. This enables the interface between the base sheet and the transparent resin layer can be kept smooth. The surface of the transparent resin layer on which the dark print layer is formed can also be made smooth. This transparent resin layer can be made of a cured body of an ultraviolet-curable urethane acrylate-based ink or a cured body of a thermosetting urethane ink.

As for the lightproof light guiding sheet, since the base sheet, a surface of which is smooth on at least one side, was formed by applying a coating liquid that is not dissolve to the surface of the base sheet to the surface and curing the coating liquid, a key sheet in which less light leaks from the base sheet to the transparent resin layer can be manufactured.

Since the dark print layer, which shields light, was formed by being printed on the surface of the transparent resin layer, the key sheet can have a smooth surface between the base sheet and the dark print layer, obtaining a key sheet having a superior light guiding property that light is not absorbed by the dark print layer.

As for the lightproof light guiding sheet, the transparent resin layer can be made of a resin having a lower refractive index than that of the light-guiding sheet. Thus, the light transmitting in the base sheet can be almost totally reflected on the interface between the base sheet and the transparent resin layer in the lightproof light guiding sheet and can be transmitted in its surface directions, without the light being diffused to the outside of the lightproof light guiding sheet.

As for the lightproof light guiding sheet, the difference in refractive index between the transparent resin layer and the base sheet can take a value of 0.06 or more. Thus, the light transmitting in the base sheet can be totally reflected efficiently on the interface between the base sheet and the transparent resin layer toward the interior of the base sheet. This can make the light transmitting in the base sheet hard to enter the dark print layer, and light absorption by the dark print layer can be lessened. Thus, even when the dark print layer is added to the base sheet, the light transmitting in the base sheet cannot be easily absorbed by the dark print layer and a decrease in the illumination brightness can be reduced.

As for the lightproof light guiding sheet, if the light-guiding sheet further has rubber elasticity, when the key sheet is pressed, the base sheet can be easily deformed, and a superior pressing operation feeling can be thereby obtained without having to increase the pressing load.

As for the lightproof light guiding sheet, the light-guiding sheet can have rubber elasticity equivalent to a rubber hardness of A50 to A90 stipulated in JIS K6253. Then, when the key sheet is pressed, the base sheet is appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

As for a push-button switch that includes an illuminatable key sheet having a base sheet formed of a transparent resin film and a depressing operation portion formed on the operation surface side of the base sheet and also includes a circuit board having a contact switch and an internal light source, there is provided a push-button switch that is characterized in that the base sheet is a light-guiding sheet, a transparent resin layer is formed on the surface of at least one side of the base sheet, a dark print layer, which shields light, is further formed on the surface of the transparent resin layer, and a smooth surface is provided between the base sheet and the dark print layer.

Since the push-button switch uses the key sheet having the lightproof light guiding sheet described above and the transparent resin layer, the light transmitting in the base sheet can be made hard to enter the dark print layer. Accordingly, almost all light can be reflected in the lightproof light guiding sheet and can be transmitted in its surface directions, without the light being diffused to the outside of the lightproof light guiding sheet. It is also possible to prevent light directed from the outside of the key sheet from transmitting through the key sheet.

As for the push-button switch, the transparent resin layer can be made of a resin having a lower refractive index than that of the base sheet. Thus, the light transmitting in the base sheet can be made hard to enter the dark print layer. Accordingly, the light can be almost totally reflected in the lightproof light guiding sheet and can be transmitted in its surface directions, without the light being diffused to the outside of the lightproof light guiding sheet.

It is also possible to prevent light directed from the outside of the key sheet from transmitting through the key sheet. That is, the push-button switch can be structured so that the key sheet has the dark print layer on the surface of at least one side of the base sheet and the dark print layer covers the spacings among the depressing operation portions on the base sheet.

As for the push-button switch, the difference in refractive index between the transparent resin layer and the base sheet can take a value of 0.06 or more. Thus, the light transmitting in the base sheet can be totally reflected efficiently on the interface between the base sheet and the transparent resin layer toward the interior of the base sheet. This can make the light transmitting in the base sheet hard to enter the dark print layer, and light absorption by the dark print layer can be lessened. Thus, even when the dark print layer is added to the base sheet, the light transmitting in the base sheet cannot be easily absorbed by the dark print layer and a decrease in the illumination brightness can be reduced.

As for the push-button switch, if the base sheet further has rubber elasticity, when the key sheet is pressed, the base sheet can be easily deformed, and a superior pressing operation feeling can be thereby obtained without having to increase the pressing load.

As for the push-button switch, the base sheet can have rubber elasticity equivalent to a rubber hardness of A50 to A90 stipulated in JIS K6253. Then, when the key sheet is pressed, the base sheet is appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

As for the push-button switch, the key sheet can have the dark print layer on the surface of the base sheet and the dark print layer can cover the spacings among the depressing operation portions on the base sheet. Thus, light leakage from the push-button switch can be prevented.

Furthermore, as for a method of manufacturing an illuminatable key sheet having a base sheet formed of a transparent resin film and depressing operation portions formed on the operation surface side of the base sheet, there is provided a method of manufacturing a key sheet, the method being characterized in that the base sheet is a light-guiding sheet, and the key sheet is manufactured by applying a coating liquid that is not dissolve to the base sheet to the surface of at least one side of the base sheet and curing the coating liquid to form a transparent resin layer thereon, and by further forming a dark print layer, which shields light, by being printed on the surface of the transparent resin layer, the key sheet having a smooth surface between the base sheet and the dark print layer.

Since the base sheet, a surface of which is smooth on at least one side, was formed by applying a coating liquid that is not dissolve to the surface of the base sheet to the surface and curing the coating liquid, a key sheet in which less light leaks from the base sheet to the transparent resin layer can be manufactured.

Since the dark print layer, which shields light, was formed by being printed on the surface of the transparent resin layer, the key sheet can have a smooth surface between the base sheet and the dark print layer, obtaining a key sheet having a superior light guiding property that light is not absorbed by the dark print layer.

As for an illuminatable key sheet having a base sheet formed of a transparent resin film and depressing operation portions formed on the operation surface side of the base sheet, there is provided a key sheet that is characterized in that the base sheet is a light-guiding sheet, a dark print layer, which shields light, is formed on the surface of at least one side of the base sheet, and a smooth surface is provided between the base sheet and the dark print layer.

That is, a structure in which the transparent resin layer is eliminated from the structure of the key sheet described above is possible. Even in this structure, as with an illuminatable key sheet having a base sheet and depressing operation portions, the interface between the base sheet of the light-guiding sheet formed of a transparent resin film and the dark print layer was formed as a smooth surface that prevents the light transmitting in the base sheet in its surface directions from entering the dark print layer. Since the smooth surface is provided between the base sheet and the dark print layer, that is, since the surface of the base sheet that faces the dark print layer or the surface of the dark print layer that faces the base sheet is smooth, or these two surfaces are smooth, the light transmitting in the base sheet can be made hard to enter the dark print layer and light absorption by the dark print layer can be avoided.

Furthermore, in an illuminatable key sheet having key tops, a base sheet, which is a light-guiding sheet used as a path through which light used to illuminate the key tops passes, the key tops being mounted on the base sheet, and a dark print layer, formed on the surface of at least one side of the base sheet, which prevents light from leaking in the thickness direction of the base sheet, the dark print layer being made of any one of a non-solvent urethane-based ink, an aqueous-based or alcohol-based curable ink, an EB-curable ink, and an ultraviolet-curable ink, there is provided a key sheet in which the base sheet is formed from a transparent resin film and the interface between the resin film and the dark print layer is formed as a smooth surface that prevents the light transmitting in the base sheet in its surface directions from entering the dark print layer.

That is, in an illuminatable key sheet having key tops, a base sheet on which the key tops are mounted, and a dark print layer, formed on the surface of at least one side of the base sheet, which prevents light from leaking in the thickness direction of the base sheet, the base sheet was made of a transparent resin film and the interface between the resin film and the dark print layer was formed as a smooth surface that prevents the light transmitting in the base sheet in its surface directions from entering the dark print layer. Since the smooth surface is provided between the base sheet and the dark print layer, that is, since the surface of the base sheet that faces the dark print layer or the surface of the dark print layer that faces the base sheet is smooth, or these two surfaces are smooth surfaces, the light transmitting in the base sheet can be made hard to enter the dark print layer and light absorption by the dark print layer can be avoided.

The dark print layer is formed from any one of a non-solvent urethane-based ink, an aqueous-based or alcohol-based curable ink, and an EB-curable ink or with a cured body of a non-erosive non-solvent-type coating liquid. Since the dark print layer was made of any one of a non-solvent urethane-based ink, an aqueous-based or alcohol-based curable ink, and an EB-curable ink or with a cured body of a non-erosive non-solvent-type coating liquid, adhesiveness to the base sheet is superior, and after the application of the ink or coating liquid, it can be adequately cured. When an ultraviolet-curable ink is used, a curable reaction starts upon exposure to ultraviolet light, so pigments or colorants included in the dark print layer absorb the ultraviolet light, causing the risk that an adequate curable reaction is not obtained except on the surface. The above inks are preferable in that there is no such a risk.

The dark print layer can be made of a cured body of a coating liquid that is not dissolve to the surface of the base sheet. Since the dark print layer is made of a cured body of a coating liquid that is not dissolve to the surface of the base sheet, the surface of the base sheet can be kept smooth, without the surface being made rough due to the formation of the dark print layer. When the cross section of the base sheet is observed, reflection of bright light that was incident on the cross section opposite to the observed cross section can be observed. When the dark print layer has a rough surface (non-smooth surface) made of an erosive coating liquid, however, diffuse reflection can be observed; the entire observed cross section is dark as if it were deglossed.

The dark print layer can have a lower refractive index than that of the base sheet, which is in contact with the dark print layer. Then, the critical angle in total reflection on the surface in contact with the dark print layer can be increased and the amount of light incident on the dark print layer can be thereby reduced. Accordingly, light absorption by the dark print layer can be avoided.

The transparent resin film that forms the base sheet can have rubber elasticity. Rubber elasticity not only easily causes deformation with a low load but also produces a restoring force due to stress generated during deformation. Accordingly, if the base sheet has rubber elasticity, it can ease input operation during a press input, without the need to increase the pressing load; after the press input, stress generated due to the warp deformation of the base sheet during the press input is exerted as the restoration force of the base sheet, by which the base sheet is restored to the state before the pressing operation, enabling the pressing operability to be improved and also enabling a superior pressing operation feeling to be obtained.

As for a key sheet that lacks a transparent resin layer as well, if the base sheet formed of a transparent resin film has rubber elasticity, when the key sheet is pressed, the base sheet can be easily deformed and a superior pressing operation feeling can be thereby obtained without having to increase the pressing load.

As for a key sheet that lacks a transparent resin layer as well, the base sheet can have rubber elasticity equivalent to a rubber hardness of A50 to A90 stipulated in JIS K6253. Then, when the key sheet is pressed, the base sheet is appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

As for a key sheet that lacks a transparent resin layer as well, the diffusing parts can be formed on the surface of at least one side of the base sheet to transmit the light transmitting in the surface directions of the base sheet to the depressing operation portions and key tops.

Since the diffusing parts of this type were formed, the light transmitting in the surface directions of the base sheet can be diffused by the diffusing parts to illuminate the depressing operation portions and key tops. The diffusing parts can be distributed in a dot pattern. If the diffusing parts are distributed in a dot pattern, illumination brightness can be adjusted for each push-button switch and each key top by appropriately adjusting the size and shape of each diffusing part and the spacings among diffusing parts.

The diffusing part can include a filling material that increases its refractive index or reflection coefficient, that is, the diffusing part can be formed by, for example, printing a resin ink to which a filling material having a high refractive index, a filling material having a high light reflection coefficient, or the like is added.

The interface between the base sheet and the diffusing parts can be formed as a rough surface that has been dissolved by an erosive coating liquid used to form the diffusing parts. Then, since the base sheet surface to which the diffusing parts are fixed is made rough by eroding the surface during the formation of the diffusing parts, so the depressing operation portions and key tops can be illuminated with light exiting from the base sheet through the diffusing parts.

In the structure in the present invention in which a smooth surface is provided between the base sheet and the dark print layer, the diffusing parts of this type can particularly efficiently transmit light to the depressing operation portions and key tops.

As for a key sheet that lacks a transparent resin layer as well, the distribution of the diffusing parts can be shaped so as to form a display element. In prior art, a character, a symbol, and another display element printed on each depressing operation portion and key top are illuminated with back light and differences in the amount of transmitting light and in color tones among the display elements are used so that the display elements can be visually recognized with ease. By contrast, since the distribution shape of the diffusing parts was used to form a display element, the display element can be visually recognized without having to forming the display element separately on the depressing operation portion and key top. Unlike the display element formed on a printed layer, the display element formed by the diffusing parts can achieve new design in which emitted light itself forms a display element.

As for a key sheet that lacks a transparent resin layer as well, light can be guided from an outer edge of the base sheet, which extends to an outer edge of the key sheet, into the interior of the base sheet in its surface directions. Then, internal light sources such as LEDs can be disposed at ends of the key sheet, enabling the spacing between the key sheet and the circuit board on which the internal light sources are disposed to be narrowed. In comparison with a case in which light is guided from the base sheet surface, light parallel to the direction in which the light is guided can be guided. Since such light can be efficiently reflected in the light-guiding sheet, bright illumination is possible to a further area.

As for a key sheet that lacks a transparent resin layer as well, pushers can be formed on the surface of the dark print layer that is disposed opposite to the depressing operation portions and key tops with the base sheet intervening therebetween. Then, a superior pressing operation feeling can be obtained and the contact switches on the circuit board can be reliably pressed with the pushers, resulting in accurate press inputs. Since, with respect to the base sheet, each pusher is disposed across the dark print layer, it is not possible that light guided in the base sheet is reflected on a side of the pusher and is thereby visually recognized. In addition, it is not also possible that light that has been directly incident on the pusher from the outside of the key sheet is reflected on a side of the pusher and is thereby visually recognized. That is, the depressing operation portion side and key top side are illuminated with light reflected on the diffusing parts and illumination with unintended light such as light reflected on the sides of the pushers can be suppressed.

There is also provided a lightproof light guiding sheet in which a dark print layer, which shields light, is provided on the surface of at least one side of the light-guiding sheet, the lightproof light guiding sheet being made of any one of a non-solvent urethane-based ink, an aqueous-based or alcohol-based curable ink, an EB-curable ink, and an ultraviolet-curable ink, and in which a smooth surface is provided between the light-guiding sheet and the dark print layer.

That is, a structure in which the transparent resin layer is eliminated from the structure of the lightproof light guiding sheet described above is possible. Even in this structure, since the dark print layer, which shields light, is disposed on the surface of at least one side of the light-guiding sheet as with the lightproof light guiding sheet described above, it is possible to prevent light directed from the outside of the light-guiding sheet from transmitting in the light-guiding sheet in its thickness direction and exiting to the opposite surface. Accordingly, the light-guiding sheet can be used as the base sheet of an illuminatable key sheet.

Since a smooth surface is provided between the base sheet and the dark print layer, the light transmitting in the base sheet can be made hard to enter the dark print layer. Accordingly, almost all light can be reflected in the lightproof light guiding sheet and can be transmitted in its surface directions, without the light being diffused to the outside of the lightproof light guiding sheet.

If the dark print layer is formed from a cured body of a coating liquid that is not dissolve to the surface of the base sheet, the risk that the base sheet surface is dissolved is lessened. This dark print layer can be formed by applying a non-solvent-type coating liquid or an aqueous-based or alcohol-based non-erosive solvent-type coating liquid to the surface of the base sheet and curing the coating liquid. This enables the interface between the base sheet and the dark print layer can be kept smooth. The surface of the base sheet on which the dark print layer is formed can also be made smooth. This dark print layer can be made of a cured body of an ultraviolet-curable urethane acrylate-based ink or a cured body of a thermosetting urethane ink.

As for a lightproof light guiding sheet that lacks a transparent resin layer as well, if the light-guiding sheet further has rubber elasticity, when the key sheet is pressed, the base sheet can be easily deformed, and a superior pressing operation feeling can be thereby obtained without having to increase the pressing load.

As for a lightproof light guiding sheet that lacks a transparent resin layer as well, the light-guiding sheet can have rubber elasticity equivalent to a rubber hardness of A50 to A90 stipulated in JIS K6253. Then, when the key sheet is pressed, the base sheet is appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

In a push-button switch that has an illuminatable key sheet including a key top, a base sheet, which is a light-guiding sheet used as a path through which light used to illuminate the key top passes, the key top being mounted on the base sheet, and a dark print layer, formed on the surface of at least one side of the base sheet, which prevents light from leaking in the thickness direction of the base sheet, the dark print layer being made of any one of a non-solvent urethane-based ink, an aqueous-based or alcohol-based curable ink, an EB-curable ink, and an ultraviolet-curable ink, and also has a circuit board on which a contact switch and an internal light source are mounted, there is provided a push-button switch in which the base sheet is made of a transparent resin film and the interface between the resin film and the dark print layer is formed as a smooth surface that prevents the light transmitting in the base sheet in its surface directions from entering the dark print layer.

Since the push-button switch uses the above lightproof light guiding sheet that lacks a transparent resin layer and the above key sheet that lacks a transparent resin layer, the light transmitting in the base sheet can be made hard to enter the dark print layer. Accordingly, almost all light can be reflected in the lightproof light guiding sheet and can be transmitted in its surface directions, without the light being diffused to the outside of the lightproof light guiding sheet.

As for the push-button switch that uses a lightproof light guiding sheet that lacks a transparent resin layer and a key sheet that lacks a transparent resin layer as well, if the base sheet further has rubber elasticity when the key sheet is pressed, the base sheet can be easily deformed, and a superior pressing operation feeling can be thereby obtained without having to increase the pressing load.

As for the push-button switch that uses a lightproof light guiding sheet that lacks a transparent resin layer and a key sheet that lacks a transparent resin layer as well, the base sheet can have rubber elasticity equivalent to a rubber hardness of A50 to A90 stipulated in JIS K6253. Then, when the key sheet is pressed, the base sheet is appropriately deformed, eliminating the need to increase the pressing load. In addition, there is no risk that the base sheet is distorted and the pressing operation is impaired because the base sheet is too soft. Accordingly, input operation can be reliably performed with a superior pressing operation feeling.

As for the push-button switch that uses a lightproof light guiding sheet that lacks a transparent resin layer and a key sheet that lacks a transparent resin layer as well, it is possible to prevent light directed from the outside of the key sheet from transmitting through the key sheet. That is, the push-button switch can be structured so that the key sheet has the dark print layer on at least the surface side of the base sheet, and the dark print layer covers the spacings among the depressing operation portions or the key tops on the base sheet. Thus, light leakage from the push-button switch can be prevented.

As for a method of manufacturing an illuminatable key sheet having a base sheet formed of a transparent resin film and depressing operation portions formed on the operation surface side of the base sheet, there is provided a method of manufacturing a key sheet, the method being characterized in that the base sheet is a light-guiding sheet, and the key sheet is manufactured by applying a coating liquid that is not dissolve to the surface of the base sheet to the surface of at least one side of the base sheet and curing the coating liquid to form a dark print layer, which shields light, thereon, the key sheet having a smooth surface between the base sheet and the dark print layer.

Since the dark print layer was made of a coating liquid that is not dissolve to the surface of the base sheet, a smooth surface can be formed between the base sheet and the dark print layer. That is, the surface of the base sheet that faces the dark print layer can be made smooth, and a key sheet, having a superior light guiding property that less light leaks from the base sheet to the dark print layer, can be manufactured.

In a method of manufacturing an illuminatable key sheet that includes key tops, a base sheet, which is a light-guiding sheet used as a path through which light used to illuminate the key tops passes, the key tops being mounted on the base sheet, and a dark print layer, formed on the surface of at least one side of the base sheet, which prevents light from leaking in the thickness direction of the base sheet, there is provided a method of manufacturing a key sheet in which a dark print layer, which shields light, is formed on the surface of at least one side of a base sheet formed of a transparent resin film by applying any one of a non-solvent urethane-based ink, an aqueous-based or alcohol-based curable ink, an EB-curable ink, and an ultraviolet-curable ink, which are coating liquids that are not dissolve to the surface of the base sheet, to the surface and curing the ink, and in which the interface between the resin film and the dark print layer is formed as a smooth surface that prevents the light transmitting in the base sheet in its surface directions from entering the dark print layer.

Since the dark print layer was made of a coating liquid that is not dissolve to the surface of the base sheet, a smooth surface can be formed between the base sheet and the dark print layer. That is, the surface of the base sheet that faces the dark print layer can be made smooth, and a key sheet, having a superior light guiding property that less light leaks from the base sheet to the dark print layer, can be manufactured.

As described above, ultraviolet-curable inks have a shorter pot life on a manufacturing line than other types of inks and their quality is thereby hard to manage. There is also the risk that an adequate curable reaction is not obtained except on the surface. Accordingly, a non-solvent urethane-based ink, an aqueous-based or alcohol-based curable ink, and an EB-curable ink, the quality of which is easy during mass production, are preferable.

Advantages

The key sheet and push-button switch in the present invention can make light leakage hard to occur in the dark print layer and can prevent diffusely reflected light from leaking from the spacings among depressing operation portions or key tops.

In the key sheet manufacturing method in the present invention, a key sheet in which light is hard to leak from the dark print layer can be manufactured.

The lightproof light guiding sheet in the present invention can make light from the outside of the light-guiding sheet hard to transmit in the light-guiding sheet in its thickness direction and exiting to the opposite surface.

Figure 1:
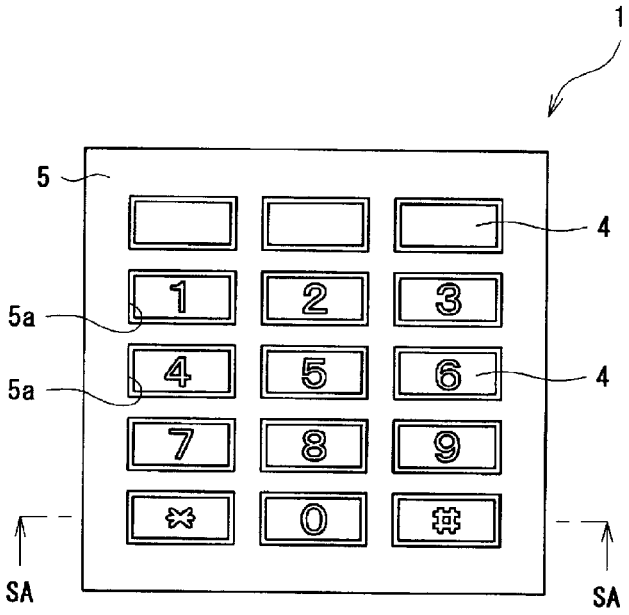
FIG. 1 is a plan view illustrating a key sheet in a first embodiment.

| Reference Characters | |
|---|---|
| 1 | key sheet (first embodiment) |
| 2 | push-button switch (first embodiment) |
| 3 | base sheet |
| 3a | front surface |
| 3b | rear surface |
| 4 | key top (depressing operation portion) |
| 5 | top cover |
| 5a | through-hole |
| 7 | diffusing part |
| 8 | pusher |
| 9 | printed layer |
| 10 | bonding layer |
| 11 | smooth surface |
| 12 | rough surface |
| 13 | case |
| 14 | circuit board |
| 15 | coned disk spring (contact switch) |
| 16 | LED (internal light source) |
| 17 | decoration layer |
| 21 | key sheet (second embodiment) |
| 22 | push-button switch (second embodiment) |
| 23 | key top (depressing operation portion) |
| 23a | concave part |
| 24 | dark print layer |
| 24a | concave part |
| 25 | diffusing part |
| 31 | key sheet (third embodiment) |
| 32 | push-button switch (third embodiment) |
| 33 | transparent resin layer |
| 33a | concave part |
| 35 | key sheet (first variation of the third embodiment) |
| 36 | key sheet (second variation of the third embodiment) |
| 37 | transparent resin layer |
| 37a | concave part |
| 38 | dark print layer |
| 41 | key sheet (fourth embodiment) |
| 42 | push-button switch (fourth embodiment) |
| 43 | key top (depressing operation portion) |
| 44 | diffusing part |
| 46 | key sheet (first variation of the fourth embodiment) |
| 47 | key sheet (second variation of the fourth embodiment) |
| 48 | key top |
| 49 | top cover |
| 51 | key sheet (fifth embodiment) |
| 52 | push-button switch (fifth embodiment) |
| 53 | dark print layer |
| 56 | key sheet (variation of the fifth embodiment) |
| 57 | diffusing part |
| 61 | key sheet (sixth embodiment) |
| 62 | push-button switch (sixth embodiment) |
| 71 | key sheet (seventh embodiment) |
| 72 | push-button switch (seventh embodiment) |
| 73 | base sheet |
| 73a | front surface |
| 73b | rear surface |
| 75 | reinforced frame |

-continued

| Reference Characters | |
|---|---|
| 76 | covering lay |
| 76a | pusher |
| 81 | key sheet (first variation of others) |
| 84 | button sheet |
| 85 | resin film |

BEST MODES FOR CARRYING OUT THE INVENTION

Embodiments of the present invention will be described with reference to the drawings. In a structure common to each embodiment, like reference characters are assigned and repeated descriptions will be omitted. As for raw materials, manufacturing method, effects, and the like common to each embodiment as well, repeated descriptions will be omitted.

First Embodiment

FIGS. 1 to 4

Figure 2:
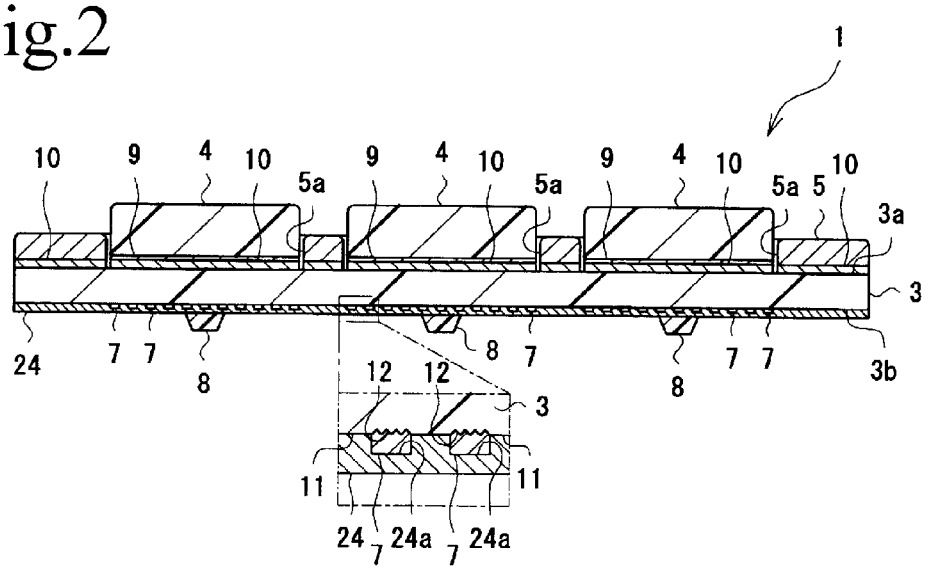
FIG. 2 is a cross sectional view as taken along line SA-SA in FIG. 1.
Figure 3:
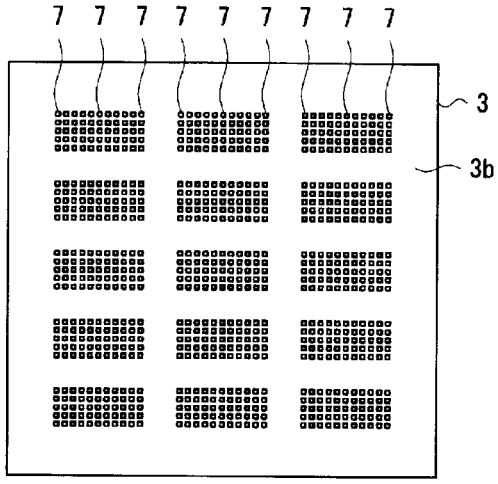
FIG. 3 is a bottom view of a base sheet used in the key sheet in the first embodiment.
Figure 4:
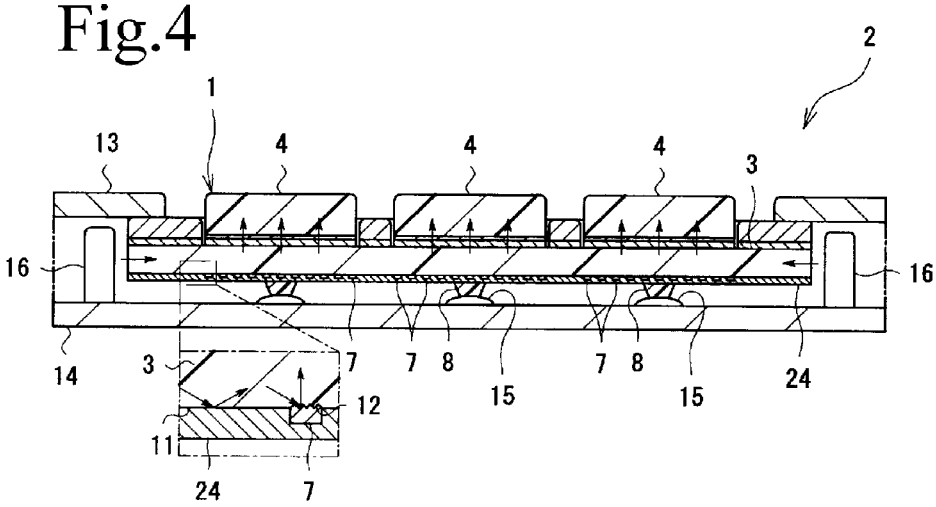
FIG. 4 is an enlarged view of a push-button switch including the key sheet in the first embodiment.

A key sheet 1 in this embodiment is shown in FIGS. 1 to 3. A push-button switch 2 in this embodiment is shown in FIG. 4. FIG. 1 is a plan view of the key sheet 1, FIG. 2 is a cross sectional view of the key sheet 1 taken along line SA-SA. FIG. 3 is a bottom view of a base sheet 3 used in the key sheet 1. FIG. 4 is an enlarged view of a push-button switch 2 including the key sheet 1. The key sheet 1 in this embodiment includes the base sheet 3, key tops 4, a top cover 5, a dark print layer 24, diffusing parts 7, and pushers 8.

The base sheet 3 is made of a transparent resin film, which is a member used as the base material of the key sheet 1. The transparent base sheet 3 also functions as "a light-guiding sheet" that transmits light in its surface directions.

A highly transparent thermoplastic resin is used as the material of the resin film used to form the base sheet 3. Exemplary resins include polycarbonate resins, acrylic resins, urethane resins, and polyethylene terephthalate resins. Preferable resins are polycarbonate resins, polymethyl methacrylate resins, acrylic resins, urethane resins, and other highly transparent resins that have no waveform absorbing area in the visible light range.

The surface of the base sheet 3 is a smooth surface 11 that is flat and transparent. Apparently, the smooth surface 11 of this type is not subjected to grain finishing or other treatment and appears to be transparent.

The thickness of the base sheet 3 is preferably within the range of 30 μm to 500 μm. If the thickness is smaller than 30 μm, the base sheet 3 is thin and the amount of light transmitting in the base sheet 3 is reduced, reducing the illumination brightness of the key sheet 1. Even if the thickness exceeds 500 μm, the amount of incident light from an internal light source can be hardly increased; instead, the base sheet 3 has a high rigidity and the pressing load to be applied to the key sheet 1 must be thereby increased, impairing operability. In light of these situations, the thickness of the base sheet 3 is more preferably 100 μm to 300 μm.

Figure 27:
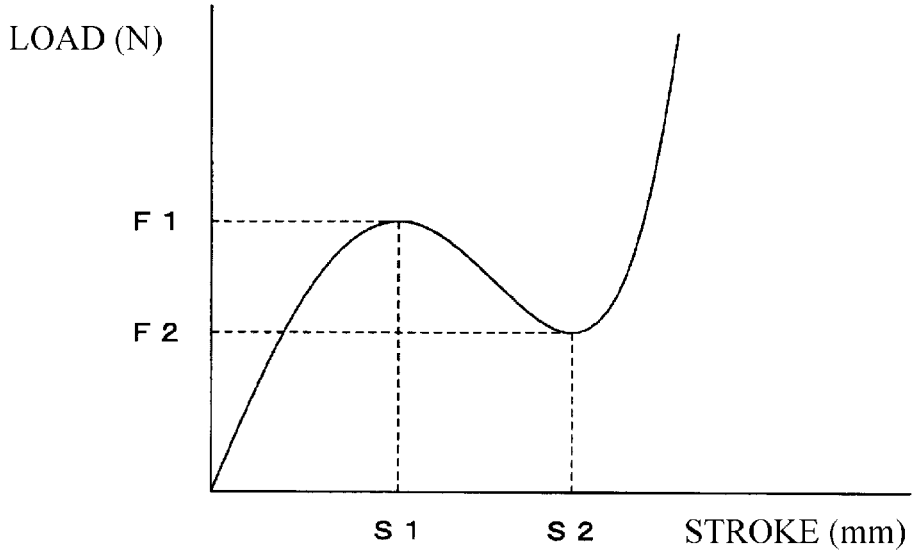
FIG. 27 illustrates a pressing load curve.

To provide superior pressing operability for the key sheet 1, the base sheet 3 is preferably soft. Superior pressing operability refers to, for example, that the maximum load (F1) on the pressing load curve in FIG. 27 is not larger than necessary and a superior click ratio (described later) is obtained. To form the base sheet 3 of this type, a rubber elastic body can be used. An exemplary rubber elastic body is the above-mentioned urethane resin. Specifically, the rubber elastic body preferably has a rubber hardness of A50 to A90 stipulated in JIS K6253. If the rubber hardness is higher than A90, the rigidity of the key sheet becomes high, increasing the load and reducing the click ratio. If the rubber hardness is lower than A50, the base sheet may be largely distorted and light guiding performance may be lowered. In addition, a pressing projection may be largely deformed and the pressing operation may be impaired.

The key top 4, which is made of a transparent resin, is formed in a rectangular shape in plan view. The key top 4 is "the depressing operation portion" of the key sheet 1. A printed layer 9 indicating a display element is formed on the rear surface opposite to the top surface, which is the press surface of the key top 4. The key top 4 formed in this way is arranged with the top cover 5 descried later and then fixed to a front surface 3*a*, which is on the operation surface side of the base sheet 3, with a bonding layer 10.

A highly transparent thermoplastic resin or reaction curable resin is used as the material of the resin used to form the key top 4. Exemplary resins include polycarbonate resins, acrylic resins, urethane resins, polyethylene terephthalate resins, epoxy resins, and silicone resins.

As for the bonding layer 10, if at least a thing that fixes the key top 4 is translucent, the key top 4 can be back lit.

The bonding layer 10 is preferably made of a resin having a lower refractive index than that of the base sheet 3. This is because light to be guided can then be efficiently reflected on the interface between the bonding layer 10 and the front surface 3*a* of the base sheet 3. If the bonding layer 10 has the same refractive index as the base sheet 3, light cannot be reflected on the interface. Therefore, the light transmitting in the base sheet 3 is largely attenuated in the bonding layer 10, and the amount of light that can be guided from the light source to a farther area is largely reduced in the base sheet 3. In a case as well in which the bonding layer 10 has a larger refractive index than that of the base sheet 3, the refraction efficiency is low, so the amount of light that can be guided is reduced. The above reflection efficiency is an efficiency when the light guided in the base sheet 3 enters the interface at an acute angle. Light that has been diffusely reflected at the diffusing part 7 toward the key top 4 enters the interface at an obtuse angle, so the light is hardly reflected and thereby the low refractive index of the bonding layer 10 does not reduce the illumination brightness.

The top cover 5, which is made of a transparent resin, is formed in a lattice shape having through-holes 5*a* in plan view. The key top 4 described above is exposed in the through-hole 5*a*. That is, the top cover 5 is disposed on the front surface 3*a* of the base sheet 3 so as to cover the spacings among the key tops 4 and the outer circumference of the key tops 4.

A transparent thermoplastic resin is used as the material of the resin used to form the top cover 5. Exemplary resins include polyethylene resins, polypropylene resins, polystyrene resins, polycarbonate resins, polyethylene terephthalate resins, polybutylene terephthalate resins, acrylic resins, polyamide resins, polyurethane resins, and acrylonitrile butadiene styrene copolymer resins.

The dark print layer 24, which is made of a resin coating, is colored in a dark color such as black or navy blue, making light hard to transmit. This dark print layer 24 is fixed to the smooth surface 11 of the rear surface 3*b* of the base sheet 3. The dark print layer 24 has concave parts 24*a*, each of which is filled with one diffusing part 7.

For the dark print layer 24, a non-erosive coating liquid, such as a non-erosive ink or paint, that is not dissolve to the surface of the base sheet 3 is used. This is because if an ink or paint including a solvent that is dissolve to the surface of the base sheet 3 is used, the surface of the base sheet 3 may be made rough. Specific examples of coating liquids that are not dissolve to the surface of the base sheet 3 include non-solvent urethane-based inks, aqueous-based or alcohol-based curable inks, and EB-curable inks.

When the dark print layer 24 is formed by being printed on the rear surface 3*b* of the base sheet 3 as in this embodiment, the dark print layer 24 is preferably made of a resin having a lower refractive index than that of a resin used to form the base sheet 3.

The thickness of the dark print layer 24 is preferably within the range of 5 μm to 50 μm. This is because if the thickness is smaller than 5 μmm, the external light shielding effect of light is lowered and because even if the thickness is more than 50 μm, the external light shielding effect remains unchanged.

It is preferable for the dark print layer 24 to completely prevent light leakage toward the thickness direction of the base sheet 3. This is because illumination of the key sheet is particularly useful when the surrounding is dark and because even a small amount of light leakage may be visually recognized in such a dark environment. To form the dark print layer 24, a non-solvent urethane-based ink, an aqueous-based or alcohol-based curable ink, an EB-curable ink, or an ultraviolet-curable ink can be used. When exposed to ultraviolet light, the ultraviolet-curable ink starts to be cured. If pigments or colorants included in the dark print layer absorb the ultraviolet light, however, the curable reaction may not be started. Accordingly, as more pigments or colorants are included to increase the light shielding effect, light becomes harder to reach the interior, except the surface, and an adequate curable reaction may not occur. That is, to reliably shield light, a non-solvent urethane-based ink, an aqueous-based or alcohol-based curable ink, or an EB-curable ink is preferably used.

The diffusing part 7 is made of a resin coating to which a filling material having a high refractive index, a filling material having a high light reflection coefficient, or the like has been added. The diffusing part 7 changes the reflection direction of light to change the progress path of the light. The diffusing part 7 is fixed to a rough surface 12 of the rear surface 3*b* of the base sheet 3. As shown in FIG. 3, the diffusing parts 7 are distributed in a dot pattern in correspondence to the shape of the key top 4. That is, the diffusing parts 7 transmit the light transmitting in the surface directions of the base sheet 3 to the key tops 4.

As the material of the resin used to form the diffusing part 7, a resin printable on the base sheet 3 is used. Exemplary resins include polycarbonate resins, acrylic resins, urethane resins, polyethylene terephthalate resins, vinyl chloride resins, ester resins, and epoxy resins. Exemplary filling materials having a high refractive index and exemplary filling materials having a high light reflection coefficient include titanium oxides.

In this embodiment, when the diffusing part 7 is fixed to the rear surface 3*b* of the base sheet 3, the solvent included in its ink is used to make the fixing surface of the base sheet 3 rough.

The thickness of the diffusing part 7 formed in this way can be within the range of 5 μm to 30 μm.

The pusher 8, made of a resin, is a member that presses the relevant contact switch on the circuit board disposed on the rear surface of the key sheet 1. One pusher 8 is provided on the rear surface of the dark print layer 24 in correspondence to one key top 4.

As the material of the resin used to form the pusher 8, a hard resin out of thermoplastic resins, thermosetting resins, photo-curable resins, and the like is preferable to meet required mechanical strength, durability, weight reduction, and other performance. Exemplary resins include acrylate resins, polycarbonate resins, polyethylene terephthalate resins, acrylic resins, polypropylene resins, polystyrene resins, polyacrylic copolymer resins, polyolefin resins, acrylonitrile butadiene styrene resins, polyester resins, epoxy resins, polyurethane resins, polyamide resins, and silicone resins. Preferable photo-curable resin types include ultraviolet-curable types, visible light curable types, and electron beam curable types.

Next, the method of manufacturing the key sheet 1 will be described.

The key tops 4, each of which has the printed layer 9 on its rear surface, and the top cover 5 are first fixed to the front surface 3*a* of the base sheet 3 with the bonding layer 10. The diffusing parts 7 are then printed on the rear surface 3*b* of the base sheet 3, after which the dark print layer 24 covering the diffusing parts 7 is formed by being printed on the entire rear surface 3*b* of the base sheet 3 with an ink that is not dissolve to the surface of the base sheet 3. Finally, the pushers 8 are provided on the rear surface of the dark print layer 24, obtaining the key sheet 1.

The key sheet 1, in this embodiment, obtained in this way is attached to the interior of a case 13 together with a circuit board 14 to form the push-button switch device 2.

As shown in FIG. 4, the key sheet 1 is fixed to the interior of the case 13 in such a way that the pushers 8 come into contact with coned disk springs 15, which function as contact switches, on the circuit board 14. The outer edges of the key sheet 1 face LEDs 16 provided on the circuit board 14 as the internal light sources.

When the LEDs 16 emit light, the light is incident from the outer edges of the base sheet 3 and is transmitted in the base sheet 3 in its surface directions as indicated by the arrows, after which the progress path of the light is changed by the diffusing parts 7 to a direction toward the key tops 4 to illuminate the key tops 4.

Although, in this embodiment, the key sheet 1 receives light emitted from the LEDs 16 from outer edges of the base sheet 3, if the LEDs are disposed in through-holes formed in the base sheet, the light from the LEDs can be incident on the inner edges of the through-holes.

According to the key sheet 1 and push-button switch 2 in this embodiment, since the base sheet 3 is formed as a light-guiding sheet, light can be incident on outer edges of the base sheet 3 and transmitted into the interior of the base sheet 3 for illumination and the LEDs 16 can be disposed at ends of the key sheet 1. Accordingly, the spacing between the key sheet 1 and the circuit board 14 on which the LEDs 16 are mounted can be narrowed and the push-button switch 2 can be thereby thinned.

If the base sheet 3 has rubber elasticity, when the key sheet 1 is pressed, the base sheet 3 can be easily deformed, enabling a superior pressing operation feeling to be obtained without having to increase the pressing load. Rubber elasticity also produces a restoring force due to stress generated during deformation. Accordingly, after a press input, stress generated due to the warp deformation of the base sheet 3 during the press input is exerted as the restoration force of the base sheet 3, by which the base sheet 3 is restored to the state before the pressing operation, enabling the pressing operability to be improved and also enabling a superior pressing operation feeling to be obtained.

Since the dark print layer 24 is disposed on the rear surface 3*b* of the base sheet 3, the dark print layer 24 can make light diffusely reflected between the key sheet 1 and the circuit board 14 hard to leak toward the operation surface side of the key sheet 1. Accordingly, the light diffusely reflected between the base sheet 3 and the circuit board 14 can be made hard to leak from among the key tops 4.

Furthermore, since the dark print layer 24 is made of a cured body of a coating liquid that is not dissolve to the surface of the base sheet 3, the rear surface 3*b* of the base sheet 3, to which the dark print layer 24 is fixed, can be kept as being the smooth surface 11, without the rear surface 3*b* being made rough. Accordingly, the smooth surface 11 makes the light transmitting in the base sheet 3 hard to enter the dark print layer 24, so light absorption by the dark print layer 24 can be practically avoided. Thus, even if the dark print layer 24 is disposed on the base sheet 3, the amount of light transmitting in the base sheet 3 can be made hard to reduce and the illumination brightness of the push-button switch 2 can be made hard to drop. Specifically, the dark print layer 24 can be made of any one of a non-solvent urethane-based ink, an aqueous-based or alcohol-based curable ink, an EB-curable ink, and an ultraviolet-curable ink, and the front surface 3*a* of the base sheet 3 can be kept smooth without the surface 3*a* of the base sheet 3 being made rough due to the formation of the dark print layer 24.

Furthermore, if the dark print layer 24 is made of a resin having a lower refractive index than that of the base sheet 3, the critical angle in total reflection on the rear surface 3*b* of the base sheet 3 can be increased and the amount of light incident on the dark print layer 24 can be thereby reduced. Accordingly, the amount of light transmitting in the base sheet can be made hard to reduce and the illumination brightness of the push-button switch 2 can be made hard to drop.

Since the diffusing parts 7 are disposed on the rear surface 3*b* of the base sheet 3, the key top 4 can be illuminated with the light transmitting in the surface directions of the base sheet 3. Since the fixing surface of the base sheet 3 to which the diffusing parts 7 are fixed is formed as the rough surface 12, the brightness of illumination of the key top 4 with the diffusing parts 7 can be increased.

Since the pusher 8 is disposed on the rear surface of the dark print layer 24, the coned disk spring 15 can be reliably pressed during a pressing operation, and the pusher 8 can be made invisible by the dark print layer 24 during illumination with backlight.

Second Embodiment

Figure 5:
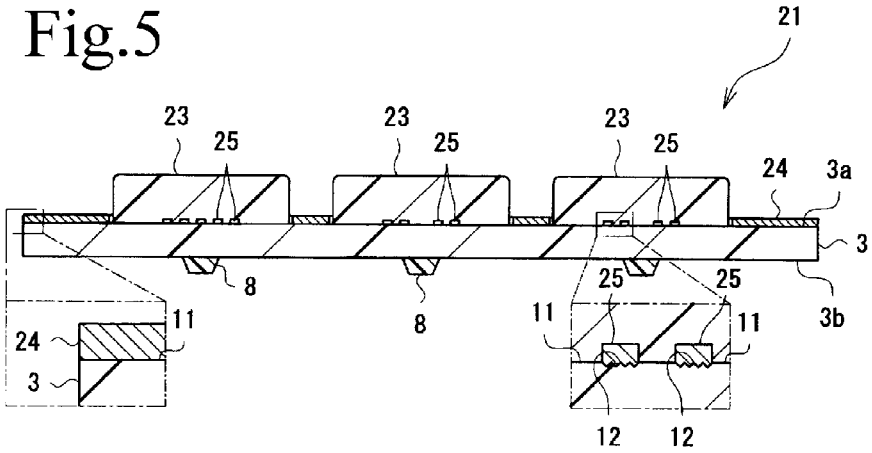
FIG. 5 is a cross sectional view, equivalent to FIG. 2, that illustrates a key sheet in a second embodiment.
Figure 6:
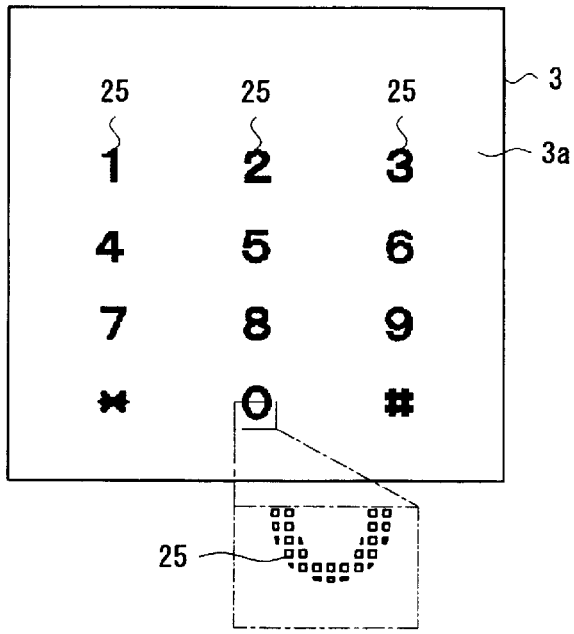
FIG. 6 is a plan view of a base sheet used in the key sheet in the second embodiment.
Figure 7:
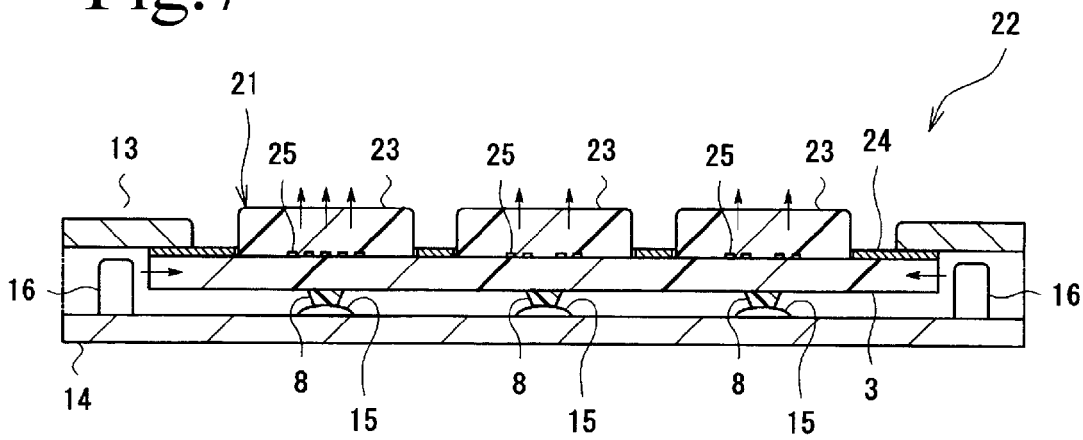
FIG. 7 is an enlarged view of a push-button switch including the key sheet in the second embodiment.

FIGS. 5 to 7

A key sheet 21 in this embodiment is shown in FIGS. 5 and 6. A push-button switch 22 in this embodiment is shown in FIG. 7. FIG. 5 is a cross sectional view of the key sheet 21. FIG. 6 is a plan view of a base sheet (light-guiding sheet) 3 used in the key sheet 21. FIG. 7 is an enlarged view of the push-button switch 22 including the key sheet 21. The key sheet 21 differs from the key sheet 1 in the first embodiment in that key tops 23, the dark print layer 24, and diffusing parts 25 are differently structured and the top cover is not included; the structures and effects of other members are the same.

The key top 23, which is a cured body of a transparent liquid resin, is formed in a rectangular shape in plan view as with the key top 4. However, a printed layer representing a display element is not formed on the rear surface, but a concave part 23*a*, which is filled with the diffusing part 25, is formed. The key top 23 is directly fixed to the front surface 3*a* of the base sheet 3.

The dark print layer 24 is formed from a resin coating made of an ink that is not dissolve to the surface of the base sheet 3, and is colored in a dark color such as black or navy blue, making light hard to transmit. This dark print layer 24 is fixed to the smooth surface 11 of the front surface 3*a* of the base sheet 3. That is, the dark print layer 24 is disposed on the front surface 3*a* of the base sheet 3 so as to cover the spacings among the key tops 23 and the outer circumference of the key tops 23.

The diffusing parts 25 are fixed to the rough surface 12 of the front surface 3*a* of the base sheet 3. As shown in FIG. 6, the distribution of the diffusing parts 25 in a dot pattern is shaped so as to form a display element. That is, the diffusing parts 25 transmit the light transmitting in the surface directions of the base sheet 3 to the key top 23 in the shape of the display element.

Next, the method of manufacturing the key sheet 21 will be described.

The dark print layer 24 and diffusing parts 25 are first formed by being printed on the front surface 3*a* of the base sheet 3. The key tops 23 are then formed on the front surface 3*a* of the base sheet 3 by using an injection mold. Finally, the pushers 8 are provided on the rear surface 3*b* of the base sheet 3, obtaining the key sheet 21.

The key sheet 21, in this embodiment, obtained in this way is attached to the interior of the case 13 together with the circuit board 14 to form the push-button switch device 22.

As shown in FIG. 7, the key sheet 21 is fixed to the interior of the case 13 in such a way that the pushers 8 come into contact with the coned disk springs 15 on the circuit board 14. The outer edges of the key sheet 21 face the LEDs 16 disposed on the circuit board 14.

When the LEDs 16 emit light, the light is incident on the outer edges of the base sheet 3 and is transmitted in the surface directions of the base sheet 3 as indicated by the arrows, after which the progress path of the light is changed by the diffusing parts 25 to a direction toward the key tops 23 for illumination in the shapes of the display elements.

According to the key sheet 21 and push-button switch 22 in this embodiment, since the dark print layer 24 covers the spacings among the key tops 23 on the base sheet 3 and the outer circumferences of the key tops 23, the light emitted from the LEDs 16 and diffusely reflected between the base sheet 3 and the circuit board 14 can be made hard to leak from the spacings among the key tops 23 and the outer circumferences of the key tops 23.

Since the diffusing parts 25 are formed in the shape of a display element, the display element can be visibly recognized without the need to form another display element on the key top 23. Unlike the display elements formed on printed layers, the display elements formed by the diffusing parts 25 can achieve new design in which emitted light itself forms display elements.

Third Embodiment

Figure 8:
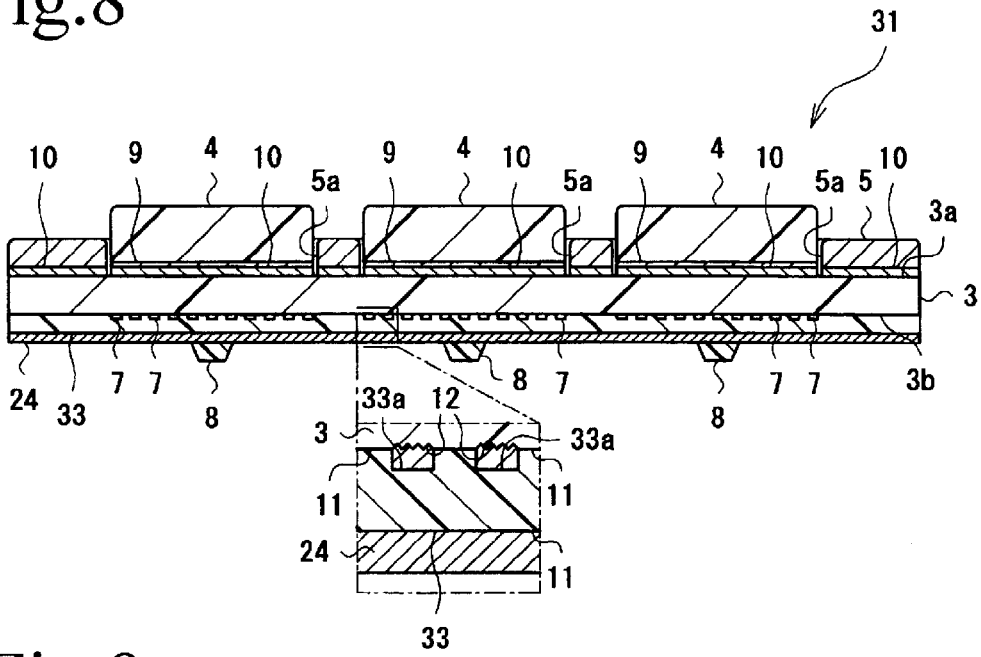
FIG. 8 is a cross sectional view, equivalent to FIG. 2, that illustrates a key sheet in a third embodiment.
Figure 9:
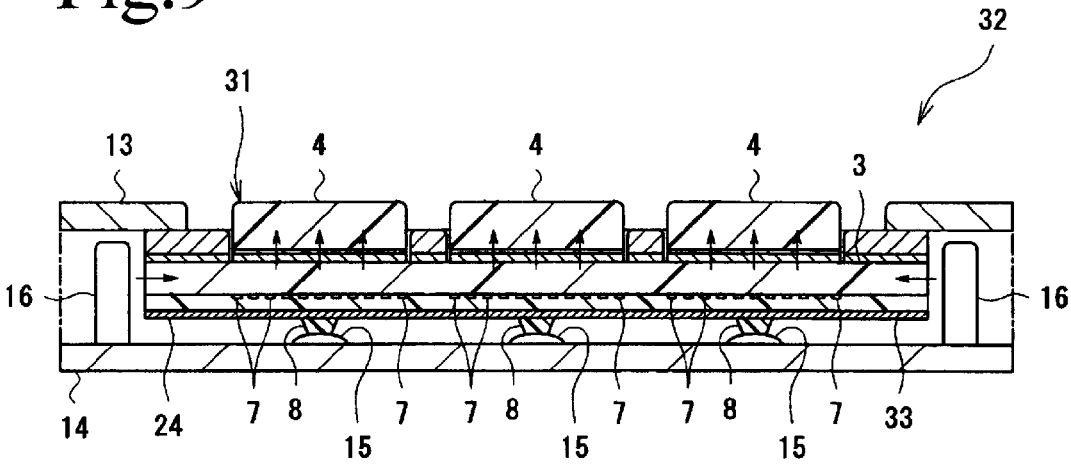
FIG. 9 is an enlarged view of a push-button switch including the key sheet in the third embodiment.
Figure 10:
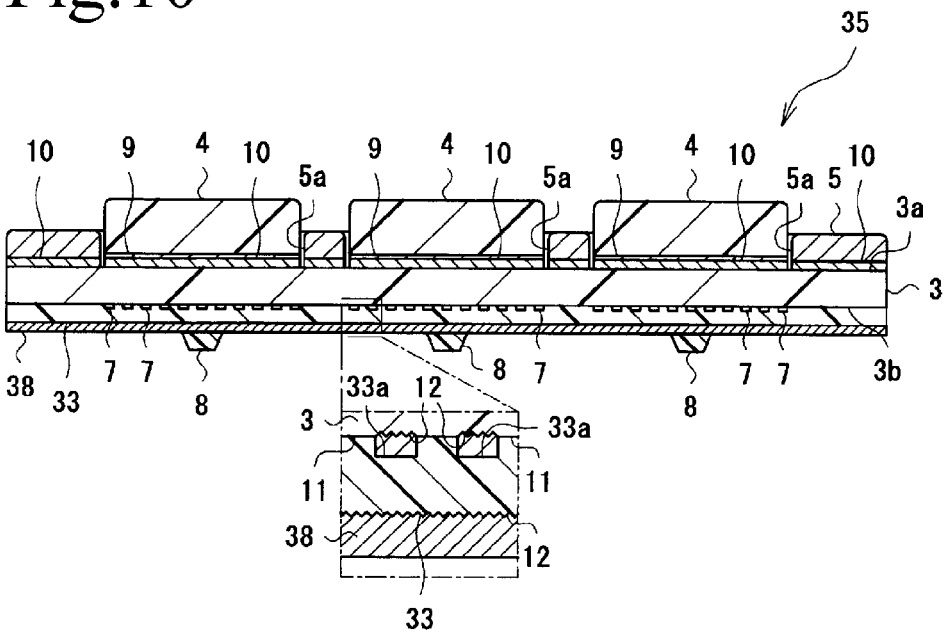
FIG. 10 is a cross sectional view, equivalent to FIG. 2, that illustrates a first variation of the key sheet in the third embodiment.
Figure 11:
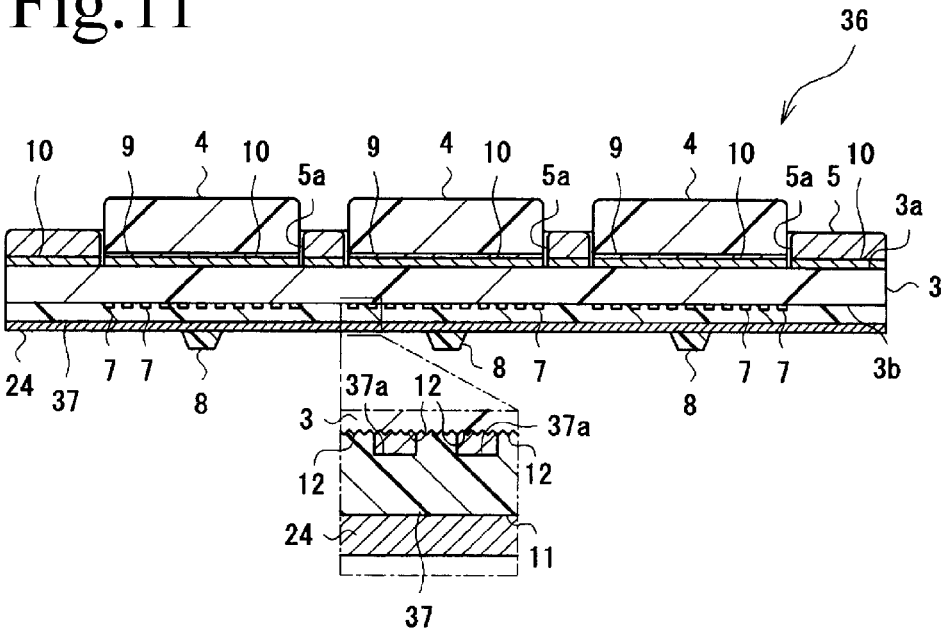
FIG. 11 is a cross sectional view, equivalent to FIG. 2, that illustrates a second variation of the key sheet in the third embodiment.

FIGS. 8 and 9

A key sheet 31 in this embodiment is shown in FIG. 8. A push-button switch 32 in this embodiment is shown in FIG. 9. FIG. 8 is a cross sectional view of the key sheet 31. FIG. 9 is an enlarged view of the push-button switch 32 including the key sheet 31. The key sheet 31 differs from the key sheet 1 in the first embodiment in the preferable structure of the base sheet 3, the inclusion of the transparent resin layer 33, and the structure of the dark print layer 24; the structures and effects of other members are the same.

Since the key sheet 31 differs from the key sheet 11 in the first embodiment in that the transparent resin layer 33 is provided, the base sheet 3 preferably has a property described below.

The higher the refractive index of the base sheet 3 is, the more suitable the base sheet 3 is. If the base sheet 3 has a high refractive index, a material usable to form the transparent resin layer 33 can be easily selected from the viewpoint of the refractive index. From this viewpoint, specifically, resins with a refractive index of 1.55 or more are preferable; specifically, urethane resins with a high refractive index of 1.55 or more and polycarbonate resins with a refractive index of about 1.59 are preferable. Furthermore, the difference in refractive index between the base sheet 3 and the transparent resin layer 33 is preferably 0.06 or more.

The transparent resin layer 33 is a transparent resin coating formed by applying a non-erosive coating liquid, such as a non-erosive ink or paint, that is not dissolve to the surface of the base sheet 3. Therefore, the interface between the base sheet 3 and the transparent resin layer 33 can be kept smooth. The surface of the transparent resin layer 33 is the smooth surface 11, which is transparent and smooth. The smooth surface 11 also apparently frees from graininess and appears to be a transparent thin film. The transparent resin layer 33 has concave parts 33*a*, each of which is filled with one diffusing part 7.

As the coating liquid that is not dissolve to the surface of the base sheet 3 on which the transparent resin layer 33 is formed, a resin liquid that is highly transparent and can be easily kept smooth is used. Specifically, a non-solvent-type cross-linked or curable resin is used; an active energy ray curable ink, such as a non-solvent-type ultraviolet-curable ink or an EB-curable ink, an aqueous-based or alcohol-based curable ink, or a thermosetting ink is used. Exemplary inks of this type include ultraviolet-curable urethane acrylate-based inks and thermosetting urethane inks. If the base sheet 3 is made of a cross-linked or curable ink, the transparent resin layer 33 can be made less likely to be dissolved by the dark print layer 24 than the base sheet.

The thickness of the transparent resin layer 33 is preferably within the range of 5 μm to 200 μm. This is because: if the thickness is smaller than 5 μmm, the diffusion effect cannot be adequately produced; even if the thickness is more than 200 μm, the effect of forming the smooth surface 11 remains unchanged and the disadvantageous that the thickness of the key sheet 31 is increased occurs instead. The thickness is more preferably within the range of 5 μm to 30 μm.

The transparent resin layer 33 preferably has a lower refractive index than that of the base sheet 3. If the transparent resin layer 33 has a lower refractive index than that of the base sheet 3, part of the light transmitting in the base sheet 3 can be totally reflected on their interface. If the difference in refractive index between the transparent resin layer 33 and the base sheet 3 is 0.06 or more, the light can be totally reflected efficiently. Then, the light transmitting in the base sheet 3 can be made hard to enter the transparent resin layer 33 and the amount of light incident on the transparent resin layer 33 is thereby reduced, so the amount of light incident on the dark print layer 24 can also be reduced. Therefore, the amount of light absorbed by the dark print layer 24 can be reduced. Accordingly, even when the dark print layer 24 is added to the base sheet 3, the light transmitting in the base sheet 3 cannot be easily absorbed by the dark print layer 24, and a decrease in the illumination brightness can be thereby reduced.

The dark print layer 24 is colored in a dark color such as black or navy blue, making light hard to transmit. The dark print layer 24 is formed by applying a non-erosive coating liquid, such as a non-erosive ink or paint, that is not dissolve to the surface of the transparent resin layer 33, the dark print layer 24 being fixed to the smooth surface 11 of the transparent resin layer 33.

When the dark print layer 24 is formed by being printed on the transparent resin layer 33 as in this embodiment, the dark print layer 24 is preferably made of a resin having a lower refractive index than that of the resin used to form the transparent resin layer 33.

Next, the method of manufacturing the key sheet 31 will be described.

The key tops 4, each of which has the printed layer 9 on its rear surface, and the top cover 5 are first fixed to the front surface 3*a* of the base sheet 3 with the bonding layer 10. The diffusing parts 7 are then printed on the rear surface 3*b* of the base sheet 3, after which the transparent resin layer 33 covering the diffusing parts 7 is printed on the entire rear surface 3*b* of the base sheet 3. The dark print layer 24 is then formed by being printed on the rear surface of the transparent resin layer 33. Finally, the pushers 8 are provided on the rear surface of the dark print layer 24, obtaining the key sheet 31.

The key sheet 31, in this embodiment, obtained in this way is attached to the interior of the case 13 together with the circuit board 14 to form the push-button switch device 32.

As shown in FIG. 9, the key sheet 31 is fixed to the interior of the case 13 in such a way that the pushers 8 come into contact with the coned disk springs 15 on the circuit board 14. The outer edges of the key sheet 31 face the LEDs 16 provided on the circuit board 14.

When the LEDs 16 emit light, the light is incident on the outer edges of the base sheet 3 and is transmitted in the surface directions of the base sheet 3 as indicated by the arrows, after which the progress path of the light is changed by the diffusing parts 7 to a direction toward the key tops 4 to illuminate the key tops 4.

According to the key sheet 31 and push-button switch 32 in this embodiment, the transparent resin layer 33 is disposed between the base sheet 3 and the dark print layer 24 and the transparent resin layer 33 is formed from a cured body of a coating liquid that is not dissolve to the surface of the base sheet 3, so the rear surface 3*b* of the base sheet 3, to which the transparent resin layer 33 is fixed, can be kept as being the smooth surface 11 during the forming of the transparent resin layer 33. Since the fixing surface of the base sheet 3 to which the transparent resin layer 33 is fixed is formed as the smooth surface 11 in this way, the smooth surface 11 makes the light transmitting in the base sheet 3 hard to enter the transparent resin layer 33 and enables the light to easily transmit in the base sheet 3. Furthermore, since the dark print layer 24 is made of a cured body of a coating liquid that is not dissolve to the surface of the transparent resin layer 33, the fixing surface of the transparent resin layer 33 to which the dark print layer 24 is fixed is formed as the smooth surface 11, without the transparent resin layer 33 being dissolved during the coating of the dark print layer 24. Accordingly, the light transmitting in the transparent resin layer 33 is not practically incident on the dark print layer 24 and can transmit in the transparent resin layer 33, so light absorption by the dark print layer 24 can be practically avoided. As described above, even when the dark print layer 24 is provided on the base sheet 3, the amount of light transmitting in the base sheet 3 can be made hard to reduce and the illumination brightness of the push-button switch 32 can be made hard to drop.

If the transparent resin layer 33 is made of a resin having a different refractive index to that of the base sheet 3, the reflection coefficient of the light transmitting in the base sheet 3 can be increased and the light can be made hard to enter the transparent resin layer 33. Accordingly, the amount of light transmitting in the base sheet 3 can be made hard to reduce and the illumination brightness of the push-button switch 32 can be made hard to drop.

If the difference in refractive index between the transparent resin layer 33 and the base sheet 3 is 0.06 or more, the light transmitting in the base sheet 3 can be totally reflected efficiently on the interface between the base sheet 3 and the transparent resin layer 33, toward the base sheet 3. Accordingly, the light transmitting in the base sheet 3 can be made hard to enter the dark print layer 24, and the amount of light absorbed by the dark print layer 24 can be reduced. Thus, even when the dark print layer 24 is added to the base sheet 3, the light transmitting in the base sheet 3 cannot be easily absorbed by the dark print layer 24, and a decrease in the illumination brightness can be thereby reduced.

Since the transparent resin layer 33 is disposed so as to cover the diffusing parts 7, contacts among the diffusing parts 7 and the dark print layer 24 can be avoided, and thereby light reflected on the diffusing parts 7 can be made hard to enter the dark print layer 24. Accordingly, the amount of light to be transmitted to the key top 4 can be made hard to reduce and the illumination brightness of the push-button switch 32 can be made hard to drop.

First Variation of the Third Embodiment

FIG. 10

As for the key sheet 31 in the third embodiment, an example has been described in which the interface between the transparent resin layer 33 and the dark print layer 24 and the interface between the base sheet 3 and transparent resin layer 33 are formed as the smooth surface 11; however, any one of these interfaces can be formed as the rough surface 12.

In a key sheet 35 in this embodiment, the interface between the base sheet 3 and the transparent resin layer 33 is formed as the smooth surface 11, but the interface between the transparent resin layer 33 and the a dark print layer 38 is formed as the rough surface 12.

Since the fixing surface of the base sheet 3 to which the transparent resin layer 33 is fixed is formed as the smooth surface 11 in this embodiment as well, the light transmitting in the base sheet 3 is not practically incident on the transparent resin layer 33. Accordingly, almost no light is transmitted to the dark print layer 38. So, an effect in which, for example, the dark print layer 38 lowers the illumination brightness of the key sheet 35 is less likely to occur.

The dark print layer 38 can be formed by using an ink or paint in which a solvent dissolve to the surface of the transparent resin layer 33 is included, so a range of choices for types of coating liquids used to form the dark print layer 38 is widened. Therefore, a coating liquid selected from the viewpoint of adhesiveness to the transparent resin layer 33, workability, prices, and the like can be used to form the dark print layer 38, without worrying about erosiveness to the transparent resin layer 33.

A solvent-type ink dissolve to the surface of the transparent resin layer 33 or the like can be used to as a coating liquid for the dark print layer 38, so a range of solvents is widened, enabling the use of a coating liquid in which a resin printable on the base sheet 3 is used. Exemplary printable resins include acrylic resins, vinyl chloride resins, ester resins, urethane resins, and epoxy resins.

In the key sheet 35, the transparent resin layer 33 is preferably made of a resin having a lower refractive index than that of the base sheet 3. Then, the critical angle in total reflection on the fixing surface of the base sheet 3 can be increased, and light leakage from the base sheet 3 to the transparent resin layer 33 can be lessened. Thus, light to be transmitted into the interior of the base sheet 3 can be easily transmitted over the entire base sheet 3, and the key sheet 35 can be brightly illuminated.

Second Variation of the Third Embodiment

FIG. 11

In a key sheet 36 in this embodiment, the interface between a transparent resin layer 37 and the dark print layer 24 is formed as the smooth surface 11, but the interface between the base sheet 3 and the transparent resin layer 37 is formed as the rough surface 12.

Since the interface between the base sheet 3 and the transparent resin layer 37 is formed as the rough surface 12 in this embodiment, light can easily enters the transparent resin layer 37 from the base sheet 3. Since the fixing surface between the transparent resin layer 37 and the dark print layer 24 is formed as the smooth surface 11 in this embodiment, however, light that has reached the transparent resin layer 37 also does not practically enter the dark print layer 24. Accordingly, the light transmitting in the base sheet 3 and transparent resin layer 37 is less likely to be absorbed by the dark print layer 24 and an effect in which, for example, the illumination brightness of the key sheet 35 is lowered is less likely to occur.

Unlike the transparent resin layer 33 described above, a solvent-type coating liquid dissolve to the surface of the base sheet 3 can be used as the coating liquid to form the transparent resin layer 37. As a coating liquid of this type, a resin liquid obtained by dissolving a polycarbonate resin, acrylic resin, urethane resin, polyethylene terephthalate resin, epoxy resin, silicone resin, or another type of resin in a solvent dissolve to the surface of the base sheet 3 can be used. The transparent resin layer 33, which is easy to form and is highly in tight contact, can be formed on the base sheet 3.

In the key sheet 36, the dark print layer 24 is preferably made of a resin having a lower refractive index than that of the base sheet 3 and transparent resin layer 33. Then, the critical angle in total reflection can be increased on the surface brought into contact with the dark print layer 24, and light directed to the dark print layer 24 can be lessened. Thus, and light absorption by the dark print layer 24 can be avoided.

Fourth Embodiment

Figure 12:
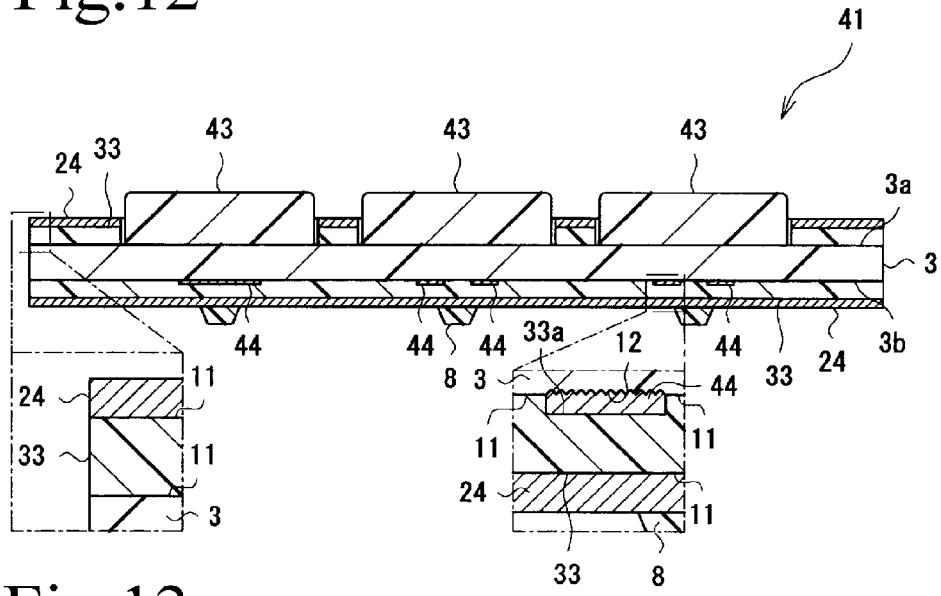
FIG. 12 is a cross sectional view, equivalent to FIG. 2, that illustrates a key sheet in a fourth embodiment.
Figure 13:
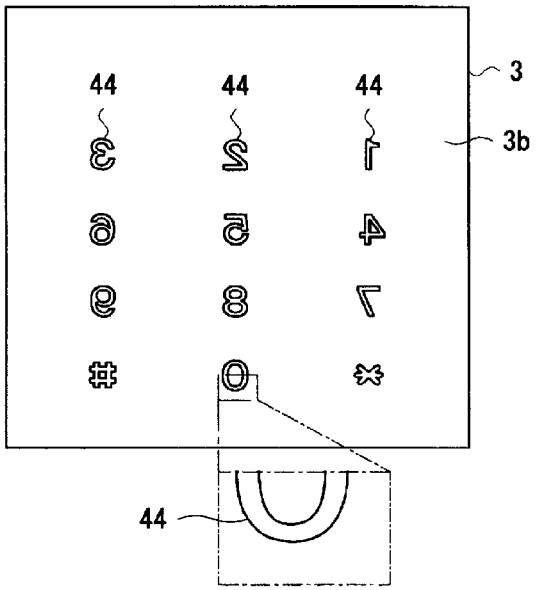
FIG. 13 is a bottom view of a base sheet used in the key sheet in the fourth embodiment.
Figure 14:
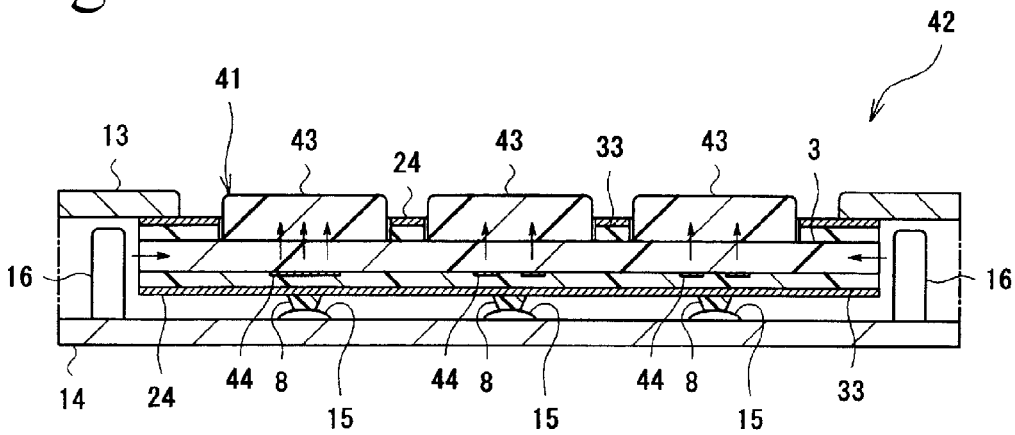
FIG. 14 is an enlarged view of a push-button switch including the key sheet in the fourth embodiment.
Figure 15:
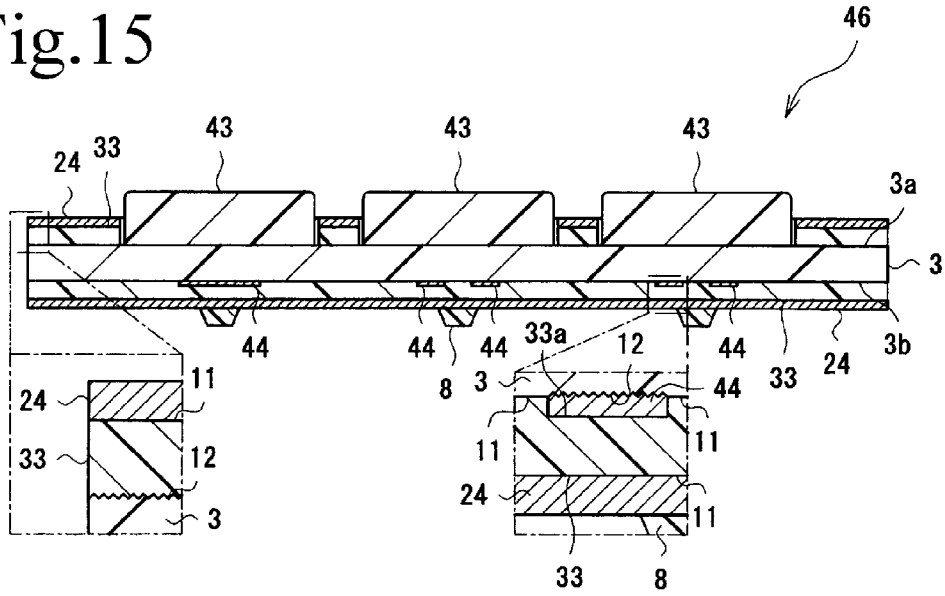
FIG. 15 is a cross sectional view, equivalent to FIG. 2, that illustrates a first variation of the key sheet in the fourth embodiment.
Figure 16:
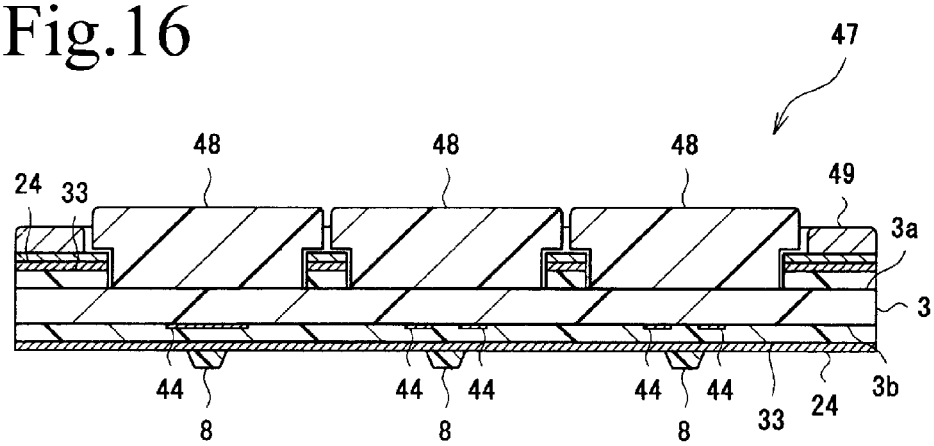
FIG. 16 is a cross sectional view, equivalent to FIG. 2, that illustrates a second variation of the key sheet in the fourth embodiment.

FIGS. 12 to 14

A key sheet 41 in this embodiment is shown in FIGS. 12 and 13. A push-button switch 42 in this embodiment is shown in FIG. 14. FIG. 12 is a cross sectional view of the key sheet 41. FIG. 13 is a bottom view of a base sheet 3 used in the key sheet 31. FIG. 14 is an enlarged view of the push-button switch 42 including the key sheet 41. The key sheet 41 differs from the key sheet 31 in the third embodiment in that key tops 43 that lack printed layers representing display elements are used, diffusing parts 44 that are layers formed in display element shapes, rather than being distributed in a dot pattern, are used, the top cover 5 is eliminated, and the transparent resin layer 33 and dark print layer 24 are provided on the operation surface side of the base sheet 3 as well. The structures and effects of other members are the same.

The key top 43, which is a cured body of a transparent liquid resin, is formed in a rectangular shape in plan view. Unlike the key top 4, the key top 43 lacks a printed layer representing a display element and is directly fixed to the front surface 3*a* of the base sheet 3.

The transparent resin layer 33 is a transparent resin coating formed by applying a non-erosive coating liquid, such as a non-erosive ink or paint, that is not dissolve to the surface of the base sheet 3, and is fixed to the smooth surface 11 of the front surface 3*a* of the base sheet 3 so as to cover the spacings among the key tops 43 and the outer circumference of the key tops 43.

The dark print layer 24 is formed from a resin coating, and is colored in a dark color such as black or navy blue, making light hard to transmit. The dark print layer 24 is formed by applying a non-erosive coating liquid, such as a non-erosive ink or paint, that is not dissolve to the surface of the transparent resin layer 33, the dark print layer 24 being fixed to the smooth surface 11 of the transparent resin layer 33.

Next, the method of manufacturing the key sheet 41 will be described.

The transparent resin layer 33 is first printed on the front surface 3*a* of the base sheet 3, and the dark print layer 24 is formed by being printed on the operation surface side of the transparent resin layer 33, after which the key tops 43 are formed on the front surface 3*a* of the base sheet 3 by using an injection mold. Next, the diffusing parts 44 are printed on the rear surface 3*b* of the base sheet 3, after which the transparent resin layer 33 covering the diffusing parts 44 is printed on the entire rear surface 3*b* of the base sheet 3. Finally, the dark print layer 24 is formed by being printed on the rear surface of the transparent resin layer 33, and the pushers 8 are provided on the rear surface of the dark print layer 24, obtaining the key sheet 41.

The key sheet 41, in this embodiment, obtained in this way is attached to the interior of the case 13 together with the circuit board 14 to form the push-button switch device 42.

As shown in FIG. 13, the key sheet 41 is fixed to the interior of the case 13 in such a way that the pushers 8 come into contact with the coned disk springs 15 on the circuit board 14. The outer edges of the key sheet 41 face the LEDs 16 provided on the circuit board 14.

When the LEDs 16 emit light, the light is incident on the outer edges of the base sheet 3 and is transmitted in the surface directions of the base sheet 3 as indicated by the arrows, after which the progress path of the light is changed by the diffusing parts 44 to a direction toward the key tops 43 for illumination in the shapes of the display elements.

According to the key sheet 41 and push-button switch 42 in this embodiment, since the dark print layer 24 is disposed on the front surface 3*a* of the base sheet 3 with the transparent resin layer 33 intervening therebetween, the dark print layer 24 can cover the spacings among the key tops 43 on the base sheet 3 and the outer circumferences of the key tops 43, and the light emitted from the LEDs 16 and diffusely reflected between the key sheet 41 and the circuit board 14 can be prevented from leaking from the operation surface side of the key sheet 41.

Since the diffusing parts 44 are formed in the shape of a display element as shown in FIG. 12, the display element can be visibly recognized without the need to form another display element on the key top 43. Unlike the display elements formed on printed layers, the display elements formed by the diffusing parts 44 can achieve new design in which emitted light itself forms display elements.

First Variation of the Fourth Embodiment

FIG. 15

In a key sheet 46 in this embodiment, the fixing surface of the base sheet 3 to which the transparent resin layer 37 is fixed is formed as the rough surface 12.

Since the fixing surface of the transparent resin layer 37, which is fixed to the dark print layer 24, is formed as the smooth surface 11, the light that has been directed from the base sheet 3 to the transparent resin layer 37 can be made hard to enter the dark print layer 24, so light absorption by the dark print layer 24 can be practically avoided. Accordingly, the amount of light transmitting in the base sheet 3 can be made hard to reduce, and the illumination brightness of the key sheet 46 can be made hard to drop.

Second Variation of the Fourth Embodiment

FIG. 16

In a key sheet 47 in this embodiment, key tops 48 and a top cover 49 are provided and the spacing around each key top 48 is narrowed.

The key top 47 is formed so that the side on the top surface outwardly extends, and the top cover 49 is formed in a frame that lacks partitioning bars. A decoration layer 17 is formed on the operation surface side of the dark print layer 24. In this embodiment as well, as with the key sheet 41, the surface of the dark print layer 24 that faces the transparent resin layer 33 is also formed as the smooth surface 11 and, conversely, the surface of the transparent resin layer 33 that faces the dark print layer 24 is also formed as the smooth surface 11.

With the key sheet 47, light can be made hard to leak from the spacings among the key tops 48, which are placed at small intervals from a visual viewpoint. The outer edges and circumference of the key top 48 are decorated by the decoration layer 17, and light radiated in a display element shape in which the dark print layer 24 is the background can be seen, achieving new design in the interior of the key top 48. Since the radiated light comes from the diffusing part 44 formed at the back of the decoration layer 17, a stereoscopic decoration effect in which the display element appears to sink toward the back can also be obtained for the display element.

Fifth Embodiment

Figure 17:
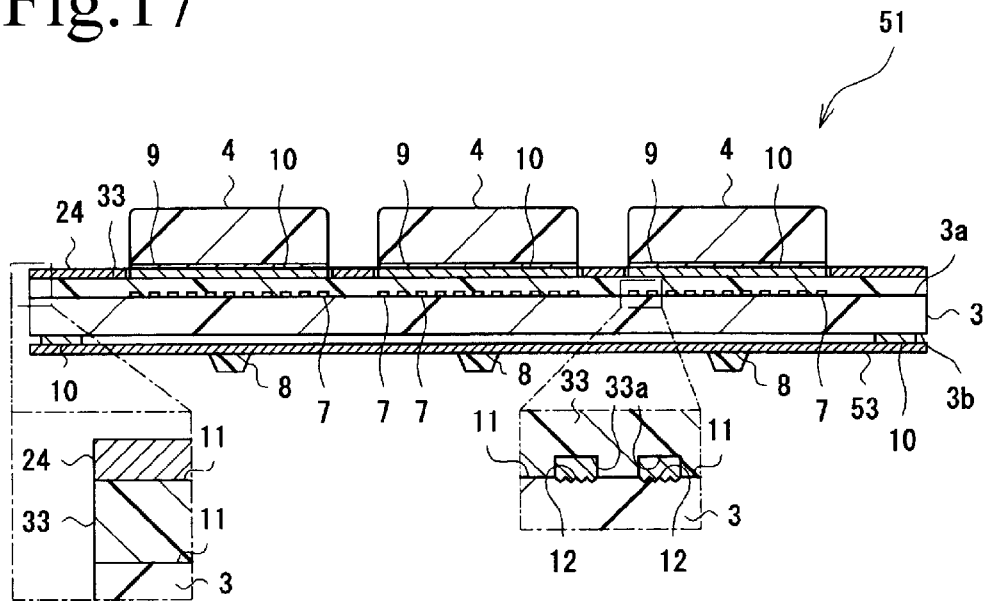
FIG. 17 is a cross sectional view, equivalent to FIG. 2, that illustrates a key sheet in a fifth embodiment.
Figure 18:
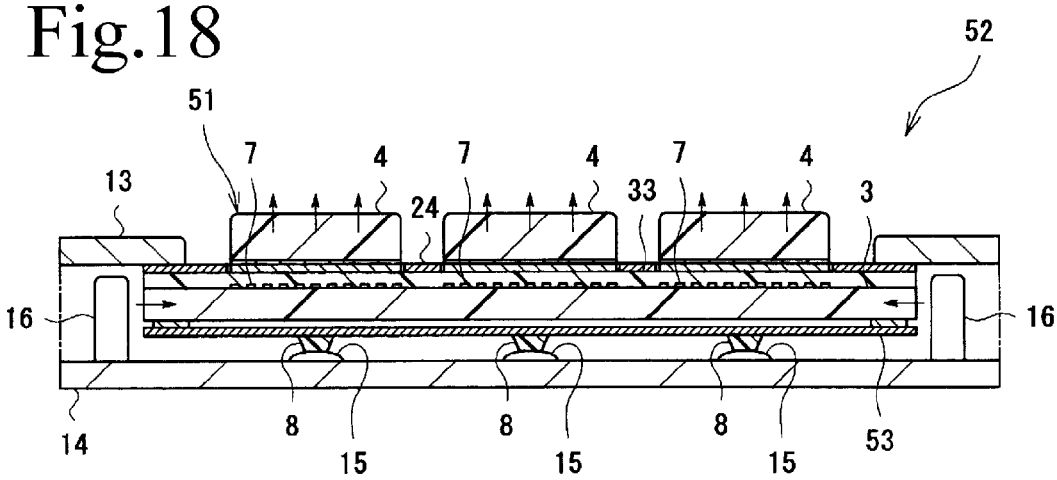
FIG. 18 is an enlarged view of a push-button switch including the key sheet in the fifth embodiment.

FIGS. 17 and 18

A key sheet 51 in this embodiment is shown in FIG. 17. A push-button switch 52 in this embodiment is shown in FIG. 18. FIG. 17 is a cross sectional view of the key sheet 51. FIG. 18 is an enlarged view of the push-button switch 52 including the key sheet 51. The key sheet 51 differs from the key sheet 31 in the third embodiment in that the top cover 5 is eliminated, the transparent resin layer 33 and dark print layer 24 are provided on the operation surface side of the base sheet 3, and a dark print layer 53 is disposed on the rear side of the base sheet 3 with the bonding layer 10 intervening therebetween. The structures and effects of other members are the same.

The transparent resin layer 33 is a transparent resin coating formed by applying a non-erosive coating liquid, such as a non-erosive ink or paint, that is not dissolve to the surface of the base sheet 3, and is fixed to the smooth surface 11 of the front surface 3*a* of the base sheet 3. The transparent resin layer 33 has the concave parts 33*a*, each of which is filled with one diffusing part 7. The fixing surface of the transparent resin layer 33 to which the dark print layer 53 is fixed is formed as the smooth surface 11. When the transparent resin layer 33 is formed on the front surface 3*a* of the base sheet 3 as in this embodiment, the transparent resin layer 33 is preferably made of a resin having a smaller refractive index than that of the base sheet 3.

The dark print layer 53 is formed from a resin film, and is colored in a dark color such as black or navy blue, making light hard to transmit. The dark print layer 53 is fixed to the base sheet 3 with the bonding layer 10 disposed along the outer circumference of the rear surface 3*b* of the base sheet 3, and the pushers 8 are provided on the rear surface of the dark print layer 53 in correspondence to the key tops 4.

Examples of the material used for the dark print layer 53 include polyethylene resins, polypropylene resins, polystyrene resins, polycarbonate resins, polyethylene terephthalate resins, polybutylene terephthalate resins, acrylic resins, polyamide resins, polyurethane resins, and acrylonitrile butadiene styrene copolymer resins.

Next, the method of manufacturing the key sheet 51 will be described.

The diffusing parts 7 are first printed on the front surface 3*a* of the base sheet 3, after which the transparent resin layer 33 covering the diffusing parts 7 is printed on the entire front surface 3*a* of the base sheet 3. The dark print layer 24 is then formed by being printed on the operation surface side of the transparent resin layer 33, after which the key tops 4, each having the printed layer 9 on the rear surface, are fixed with the bonding layer 10. Finally, the dark print layer 53, which is made of a resin film and has the pushers 8 on the rear surface, is fixed to the rear surface 3*b* of the base sheet 3 with the bonding layer 10, obtaining the key sheet 51.

The key sheet 51, in this embodiment, obtained in this way is attached to the interior of the case 13 together with the circuit board 14 to form the push-button switch device 52.

As shown in FIG. 17, the key sheet 51 is fixed to the interior of the case 13 in such a way that the pushers 8 come into contact with the coned disk springs 15 on the circuit board 14. The outer edges of the key sheet 51 face the LEDs 16 provided on the circuit board 14.

When the LEDs 16 emit light, the light is incident on the outer edges of the base sheet 3 and is transmitted in the surface directions of the base sheet 3 as indicated by the arrows, after which the progress path of the light is changed by the diffusing parts 7 to a direction toward the key tops 4 to illuminate the key tops 4.

According to the key sheet 51 and push-button switch 52 in this embodiment, since the transparent resin layer 33 is made of a resin having a smaller refractive index than that of the base sheet, the critical angle in total reflection on the front surface 3*a* of the base sheet 3 can be increased and light leakage from the base sheet 3 can be lessened. Thus, light to be transmitted into the interior of the base sheet 3 can be easily transmitted over the entire base sheet 3, and the key tops 4 can be brightly illuminated through the diffusing parts 7.

Since the dark print layer 53 covers the rear surface 3*b* of the base sheet 3, it is possible to prevent the light that has been diffusely reflected between the key sheet 51 and the circuit board 14 from entering the interior of the base sheet 3 from the rear surface 3*b* of the base sheet 3. Furthermore, since the dark print layer 24 disposed on the surface of the base sheet 3 cover the spacings among the key tops 4 on the transparent resin layer 33 and the outer circumferences of the key tops 4, it is also possible to prevent light from easily leaking from the operation surface side of the key sheet 51.

Variation of the Fifth Embodiment

FIG. 19

Figure 19:
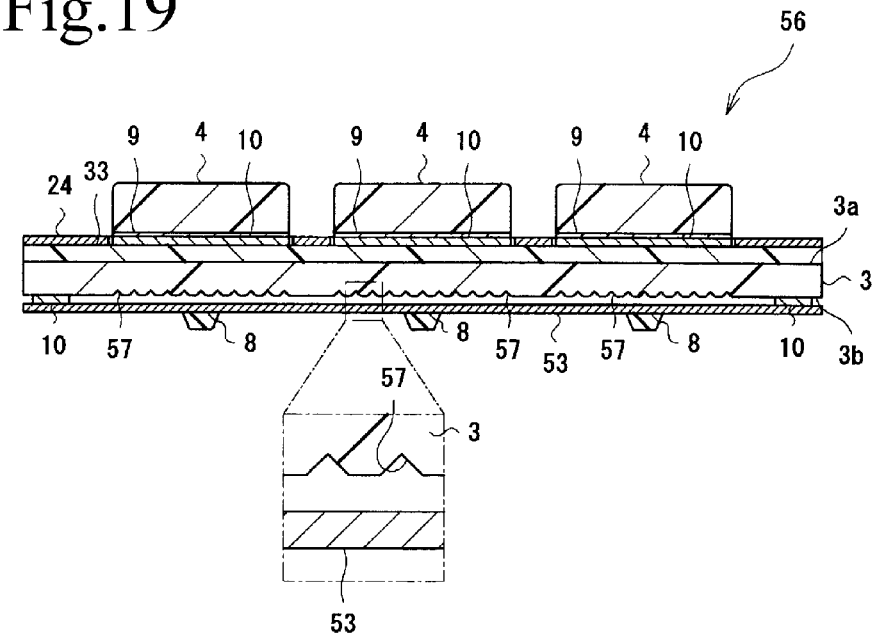
FIG. 19 is a cross sectional view, equivalent to FIG. 2, that illustrates a variation of the key sheet in the fifth embodiment.

FIG. 19 is a cross sectional view of a key sheet 56 in this embodiment. The key sheet 56 differs from the key sheet 51 in the fifth embodiment in that each diffusing part 57 on the base sheet 3 is formed as an uneven surface on the lower surface of the base sheet 3. This uneven surface can be formed by heating and pressing a mold having concave and convex parts corresponding to the even surface or by another method. Even in this structure, the light transmitting in the surface directions of the base sheet 3 can be reflected toward the key tops 4 to illuminate the key sheet 56. The structures and effects of other members are the same.

Since, in this variation, filling material that increases the refractive index or reflection coefficient is not included in the diffusing part 57, a transparent resin layer and dark print layer are not stacked on the diffusing part 57. Although a transparent resin layer can also be stacked on the diffusing part 57 formed in this way, if the transparent resin layer is stacked so, it needs to have a refractive index difference of 0.1 or more. This is because if the refractive index difference is small, the critical angle in reflection becomes small, the efficiency of light refection on the uneven surface becomes low, and bright illumination is thereby impaired.

Sixth Embodiment

Figure 20:
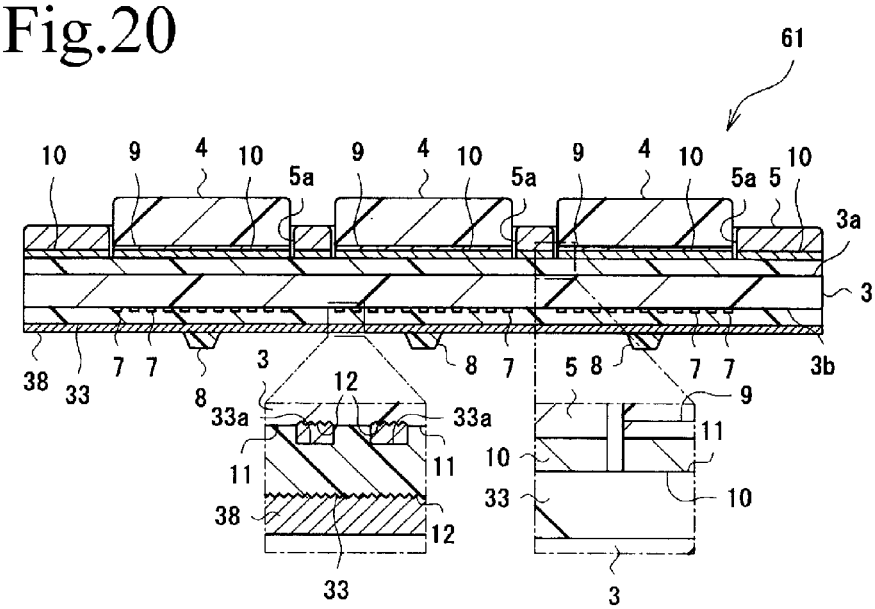
FIG. 20 is a cross sectional view, equivalent to FIG. 2, that illustrates a key sheet in a sixth embodiment.
Figure 21:
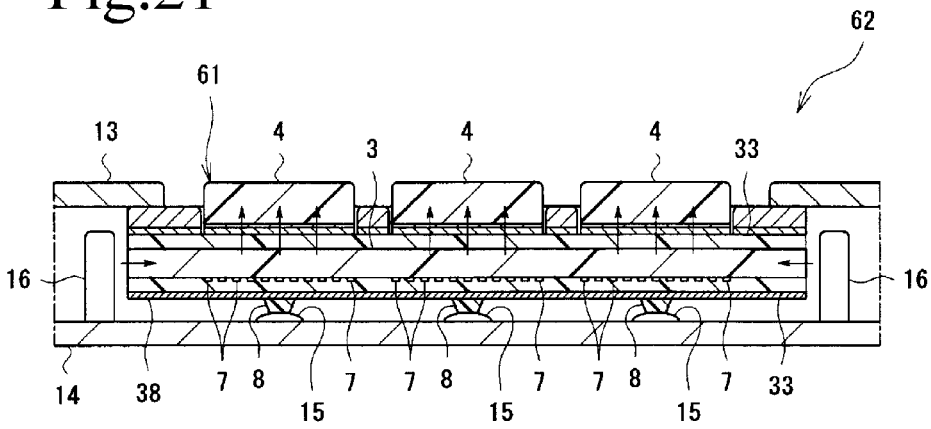
FIG. 21 is an enlarged view of a push-button switch including the key sheet in the sixth embodiment.

FIGS. 20 and 21

FIG. 20 is a cross sectional view of a key sheet key sheet 61 in this embodiment. FIG. 21 shows a push-button switch 62 in this embodiment. The key sheet 61 differs from the key sheet 35 in the first variation in the third embodiment in that the transparent resin layer 33 is disposed on the same side as the key tops 4 on the base sheet 3 and the key tops 4 and the top cover 5 are fixed to the surface of the transparent resin layer 33. In this embodiment, the transparent resin layer 33 was made of a resin having a refractive index which is lower than that of the base sheet 3 by 0.06 or more. The structures and effects of other members are the same.

The transparent resin layer 33 is a transparent resin coating formed by applying a non-erosive coating liquid, such as a non-erosive ink or paint, that is not dissolve to the surface of the base sheet 3, and is fixed to the smooth surfaces 11 of the front surface 3*a* and rear surface 3*b* of the base sheet 3. The transparent resin layer 33 on the rear surface 3*b* is disposed so as to cover the diffusing parts 7. The fixing surface of the transparent resin layer 33, to which the dark print layer 38 is fixed, disposed on the rear surface 3*b* of the base sheet 3 is the rough surface 12 dissolved by the dark print layer 38. The fixing surface of the transparent resin layer 33, which is fixed to the bonding layer, disposed on the front surface 3*a* of the base sheet 3 was formed as the smooth surface 11. In this embodiment, the transparent resin layer 33 was made of a resin having a refractive index which is lower than that of the base sheet 3 by 0.06 or more.

Next, the method of manufacturing the key sheet 61 will be described.

The diffusing parts 7 are first printed on the rear surface 3*b* of the base sheet 3, after which the transparent resin layer 33 covering the diffusing parts 7 is printed on the entire rear surface 3*b* of the base sheet 3. The dark print layer 38 is then formed by being printed on the surface of the transparent resin layer 33, after which the transparent resin layer 33 is printed on the entire front surface 3*a* on the operation surface side of the base sheet 3. The pushers 8 are then formed on the rear surface of the dark print layer 38 by using an ultraviolet-curable resin. Finally, the key tops 4, each having the printed layer 9 on the rear surface, are fixed to the transparent resin layer 33 on the operation surface side of the base sheet 3 with the bonding layer 10, obtaining the key sheet 61.

The key sheet 61, in this embodiment, obtained in this way is attached to the interior of the case 13 together with the circuit board 14 to form the push-button switch device 62.

As shown in FIG. 21, the key sheet 61 is fixed to the interior of the case 13 in such a way that the pushers 8 come into contact with the coned disk springs 15 on the circuit board 14. The outer edges of the key sheet 61 face the LEDs 16 provided on the circuit board 14.

When the LEDs 16 emit light, the light is incident on the outer edges of the base sheet 3 and is transmitted in the surface directions of the base sheet 3 as indicated by the arrows, after which the progress path of the light is changed by the diffusing parts 7 to a direction toward the key tops 4 to illuminate the key tops 4.

According to the key sheet 61 and push-button switch 62 in this embodiment, since the interface between the base sheet 3 and the transparent resin layer 33 is formed as the smooth surface 11 and, the transparent resin layer 33 is made from a resin having a refractive index which is lower than that of the base sheet 3 by 0.06 or more, the critical angle in total reflection on the interface between the base sheet 3 and the transparent resin layer 33 can be increased and light leakage from the base sheet 3 can be lessened. Thus, light to be transmitted into the interior of the base sheet 3 can be easily transmitted over the entire base sheet 3, and the key tops 4 can be brightly illuminated through the diffusing parts 7. Since the transparent resin layer 33 was disposed over the front surface 3*a* of the base sheet 3 as well, light can be efficiently reflected on the interface between the base sheet 3 and the transparent resin layer 33 and can be then transmitted over the base sheet 3, regardless of the type of resin used for the bonding layer 10.

Since the dark print layer 38 covers the rear surface 3*b* of the base sheet 3, it is possible to prevent the light that has been diffusely reflected between the key sheet 61 and the circuit board 14 from entering the interior of the base sheet 3 from the rear surface 3*b* of the base sheet 3.

Seventh Embodiment

Figure 22:
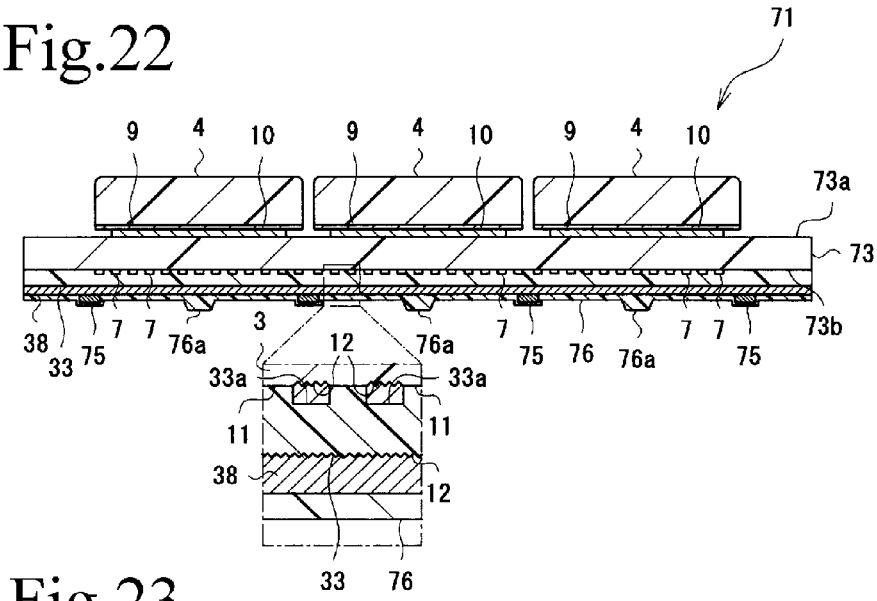
FIG. 22 is a cross sectional view, equivalent to FIG. 2, that illustrates a key sheet in a seventh embodiment.
Figure 23:
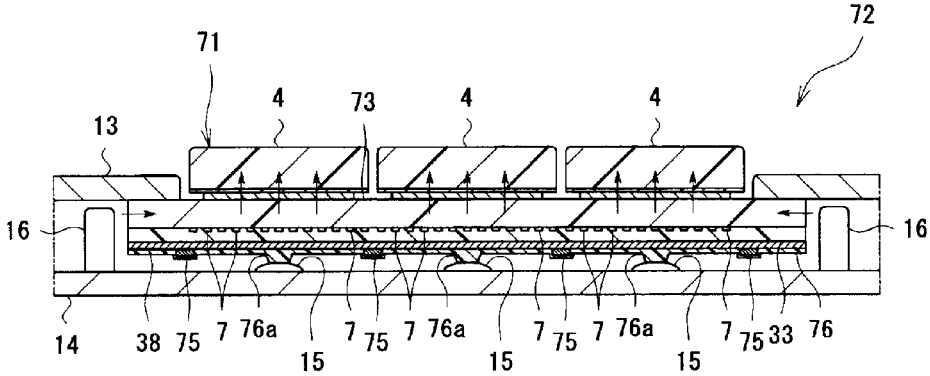
FIG. 23 is an enlarged view of a push-button switch including the key sheet in the seventh embodiment.
Figure 24:
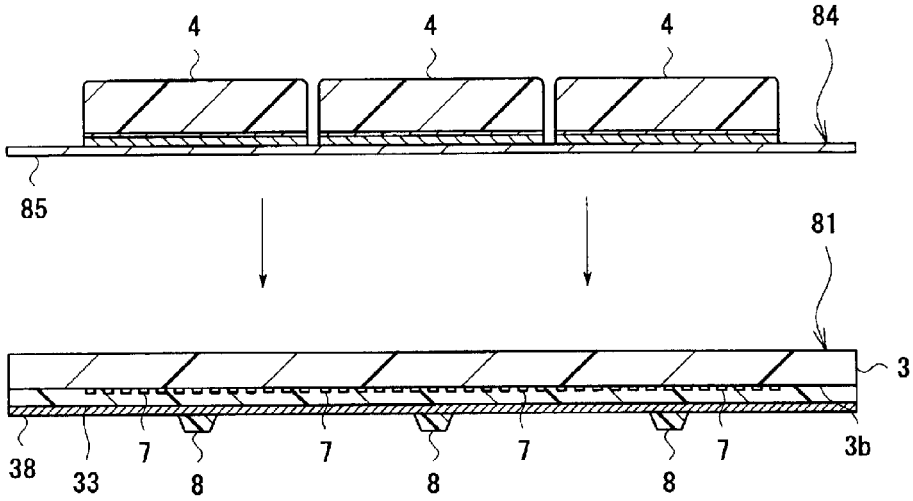
FIG. 24 is a cross sectional view, equivalent to FIG. 2, that illustrates a first variation common to the embodiments.

FIGS. 22 and 23

FIG. 22 is a cross sectional view of a key sheet 71 in this embodiment. FIG. 23 shows a push-button switch 72 in this embodiment. The key sheet 71 differs from the key sheet 35 in the first variation in the third embodiment in that a transparent resin film having rubber elasticity is used as a base sheet 73, reinforced frames 75 in a lattice shape are provided on the rear surface of the dark print layer 38, which is opposite to the transparent resin layer 33, and a covering lay 76 is provided so as to cover the reinforced frames 75 and the rear surface of the transparent resin layer 33. The key sheet 71 is structured so that key tops 4 are placed at small intervals on the front surface 73*a* of the base sheet 73 and fixed. The structures and effects of other members are the same.

The base sheet 73 is formed from a transparent resin film having rubber elasticity, the rubber hardness of which is A50 to A90 stipulated in JIS K6253. The base sheet 73 is a member used as a base material of the key sheet 71. The transparent base sheet 73 is also used as "a light-guiding sheet" that transmits light in its surface directions.

A flexible and highly transparent thermoplastic resin is used as the material of the resin film used to form the base sheet 73. A urethane resin is preferable, for example.

The front surface 73*a* of the base sheet 73 is a smooth surface 11 that is flat and transparent. Apparently, the smooth surface 11 of this type is not subjected to grain finishing or other treatment and appears to be transparent.

The thickness of the base sheet 73 is preferably within the range of 30 μm to 500 μm. If the thickness is smaller than 30 μm, the base sheet 73 is thin and the amount of light transmitting in the base sheet 73 is reduced, reducing the illumination brightness of the key sheet 71. Even if the thickness exceeds 500 μm, the amount of incident light emitted from the internal light source can be hardly increased; instead, the base sheet 73 has a high rigidity and the pressing load to be applied to the key sheet 71 must be thereby increased, impairing operability.

The reinforced frame 75 is a member formed like a bar, which is disposed between a key top 4 and another key top 4. To suppress distortion of the key sheet 71, the reinforced frame 75 is formed from a highly rigid material so that when at least an end of the reinforced frame 75 is held, it is highly less likely to warp. Examples of materials of this type include polycarbonate resins, polymethyl methacrylate resins, polypropylene resins, polystyrene resins, polyacrylic copolymer resins, polyolefin resins, acrylonitrile butadiene styrene resins, polyester resins, epoxy resins, polyurethane resins, polyimide resins, polyamide resins including polyamide-imide resins, silicone resins, amino resins such as melamine resins, allyl resins, furan resins, phenol resins, fluorocarbon resins, polyarylate resins, polyarylsulfone resins, polyethersulfone resins, polyphenylene ether resins, polyphenylene sulfide resins, and polysulfone resins. In addition, thin metal plates made of stainless steel, copper, brass, and the like can also be used. Although the thickness of the reinforced frame 75 is not limited, it preferably falls within the range of about 0.05 mm to about 0.3 mm.

The covering lay 76, made of a resin, covers the rear surface of the key sheet 71. A pusher 76*a* is provided on the covering lay 76 in correspondence for each key top 4. The pusher 76*a* presses the relevant contact switch on the circuit board.

As the material of the resin used to form the covering lay 76, a hard resin out of thermoplastic resins, thermosetting resins, photo-curable resins, and the like is preferable to meet required mechanical strength, durability, weight reduction, and other performance. Exemplary resins include acrylate resins, polycarbonate resins, polyethylene terephthalate resins, acrylic resins, polypropylene resins, polystyrene resins, polyacrylic copolymer resins, polyolefin resins, acrylonitrile butadiene styrene resins, polyester resins, epoxy resins, polyurethane resins, polyamide resins, and silicone resins. Preferable photo-curable resin types include ultraviolet-curable types, visible light curable types, and electron beam curable types.

Next, the method of manufacturing the key sheet 71 will be described.

The diffusing parts 7 are first printed on the rear surface 73*b* of the base sheet 73, after which the transparent resin layer 33 covering the diffusing parts 7 is printed on the entire rear surface 73*b* of the base sheet 73. The dark print layer 38 is then formed by being printed on the surface of the transparent resin layer 33, after which the transparent resin layer 33 is printed on the entire front surface 73*a* on the operation surface side of the base sheet 73. The reinforced frame 75 is then fixed to the rear surface of the dark print layer 38, after which the covering lay 76 is formed from an ultraviolet-curable resin on the entire rear surface of the dark print layer 38 so as to cover the reinforced frames 75. Finally, the key tops 4, each having the printed layer 9 on the rear surface, are fixed to the front surface 73*a* of the base sheet 73 with the bonding layer 10, obtaining the key sheet 71.

The key sheet 71, in this embodiment, obtained in this way is attached to the interior of the case 13 together with the circuit board 14 to form the push-button switch device 72.

As shown in FIG. 23, the key sheet 71 is fixed to the interior of the case 13 in such a way that the pushers 76*a* come into contact with the coned disk springs 15 on the circuit board 14. The outer edges of the key sheet 71 face the LEDs 16 provided on the circuit board 14.

When the LEDs 16 emit light, the light is incident on the outer edges of the base sheet 73 and is transmitted in the surface directions of the base sheet 73 as indicated by the arrows, after which the progress path of the light is changed by the diffusing parts 7 to a direction toward the key tops 4 to illuminate the key tops 4.

According to the key sheet 71 and push-button switch 72 in this embodiment, since a transparent resin film having rubber elasticity, the rubber hardness of which is A50 to A90 stipulated in JIS K6253, is used as the base sheet 73, the load is hardly increased during a pressing operation, a decrease in the click ratio is small, and a superior pressing operation feeling can be thereby maintained. With a key sheet on which key tops are placed at small intervals and fixed, the intervals among the key sheets cannot be generally pressed by the case; if the base sheet is flexible, the key sheet may be lifted or may be come off. Since the key sheet 71 in this embodiment has the reinforced frames 75 on the rear surface of the dark print layer 38, however, even if the key sheet 71 is oriented upright or inclined, the overall distortion of the key sheet 71 is suppress by the rigidity of the reinforced frame 75. Since the reinforced frames 75 are disposed among the key tops 4, the pressing operation feeling is hardly affected.

With the key sheet 71, since the interface between the base sheet 73 and the transparent resin layer 33 is formed as the smooth surface 11, light to be guided can be reflected on the interface between the base sheet 73 and the transparent resin layer 33 and light leakage from the base sheet 73 can be lessened. Thus, light to be transmitted into the interior of the base sheet 73 can be easily transmitted over the entire base sheet 73, and the key tops 4 can be brightly illuminated through the diffusing parts 7.

Since the dark print layer 38 covers the rear surface 73*b* of the base sheet 73, it is possible to prevent the light that has been diffusely reflected between the key sheet 71 and circuit board 14 from entering the interior of the base sheet 73 from the rear surface 73*b* of the base sheet 73.

First Variation of Another

FIG. 24

In the above embodiments, the key sheets 1, 21, 31, 35, 36, 41, 46, 47, 51, 56, 61, and 71 have been formed by integrally fixing the key tops 4 to the base sheets 3 and 73. In this variation, however, a button sheet 84 on which the key tops 4 are fixed to a resin film 85 may be prepared, the button sheet 84 being a member separated from a key sheet 81, and the key sheet 81 and button sheet 84 may be combined.

Then, if, for example, one key sheet 81 is prepared as the light guiding member and the button sheet 84 to which a plurality of different decorations are added is appropriately changed, many variations become possible, enabling the button sheet 84 to be easily changed. The key sheet 81 can also be combined with other than the button sheet 84 to flexibly adapt to various usage forms.

Other Variations

The embodiments described above are each just an example of embodiments of the present invention. That is, for example, whether to use the top covers 5 and 49 and whether to form the diffusing parts 7, 25, and 44 in a dot patter can be appropriately changed in each embodiment. The place at which the smooth surface 11 is formed is not also limited to the above embodiments if the smooth surface 11 is present between the base sheet 3 and the dark print layer 6, 24, 38, or 53.

It is also possible to appropriately replace part of the structure shown in an embodiment with a structure in another embodiment. The resulting variation is also included in the embodiments.

Examples

Examples will be shown below to describe the present invention in detail. Tests were carried out for "interface shape and brightness", "refractive index and brightness", "flexibility of base sheet and ease of pressing operability", and "material of dark print layer and light leakage".

"Interface shape and brightness"; Effects of the interface shape on illumination luminance were tested.

1. Manufacturing of Samples:

Samples 1 to 5 below were prepared as the base sheet (3) by using a polycarbonate resin film with a thickness of 300 μm.

Sample 1:

The key tops (4), each of which has a printed layer (9) on the rear surface, and the top cover (5) were fixed to the front surface (3*a*) of the base sheet (3), which is made of a polycarbonate resin film 300 μm thick, with the bonding layer (10). The diffusing parts (7) distributed in a dot pattern in correspondence to the shapes of the key tops (4) were printed on the rear surface (3*b*) of the base sheet (3) with a solvent-type printing ink, after which the dark print layer (24) 10 μm thick made of an aqueous-based acrylic resin was formed by being printed on the entire rear surface (3*b*) of the base sheet (3), which covers the diffusing parts (7). Then, the pushers (8) were provided on the rear surface of the dark print layer (24), forming the key sheet (1). The key sheet was used as sample 1.

As for sample 1, the dark print layer (24) is formed on the rear surface (3*b*) of the base sheet (3), but the smooth surface (11) is maintained on the front surface of the base sheet (3), which faces the dark print layer (24). In formation and maintenance of the smooth surface (11), after the dark print layer (24) was formed, it was wiped off before the dark print layer (24) was solidified, and the front surface of the base sheet (3), to which the dark print layer (24) was applied, was observed and evaluated. There was no change in the state of the front surface of the base sheet (3) between before and after the application of the dark print layer (24). As for the samples described below as well, the surface state was similarly observed to see whether the front surface was the smooth surface (11) or rough surface (12). The reason why the front surface of the base sheet (3) was the smooth surface (11) is that the base sheet (3) made of a polycarbonate resin film was not dissolved during the forming of the dark print layer (24) made of an aqueous-based acrylic resin by printing.

Sample 2:

As with sample 1, the key tops (4) and the top cover (5) were fixed to the front surface (3*a*) of the base sheet (3) with the bonding layer (10). The diffusing parts (7) distributed in a dot pattern in correspondence to the shapes of the key tops (4) were printed on the rear surface (3*b*) of the base sheet (3), after which the transparent resin layer (33) 12 μm thick made of a non-solvent-type ultraviolet-curable acrylic resin was printed on the entire rear surface (3*b*) of the base sheet (3), which covers the diffusing parts (7). Moreover, the dark print layer (24) 10 μm thick made of a urethane resin including a solvent was formed by being printed on the rear surface of the transparent resin layer (33), and the pushers (8) were provided on the rear surface of the dark print layer (24), forming the key sheet (31). The key sheet (31) was used as sample 2.

As for sample 2, the smooth surface (11) is formed on the rear surface (3*b*) of the base sheet (3), which faces the transparent resin layer (33), and the smooth surface (11) is formed on the front surface of the transparent resin layer (33), which faces the dark print layer (24). This is because the base sheet (3) made of a polycarbonate resin film was not dissolved during the forming of the transparent resin layer (33) made of a non-solvent-type ultraviolet-curable acrylic resin by printing, and the transparent resin layer (33) was not also dissolved during the forming of the dark print layer (24) made of a urethane resin including a solvent by printing.

Sample 3:

As with sample 1, the key tops (4) and the top cover (5) were fixed to the front surface (3*a*) of the base sheet (3) with the bonding layer (10). The diffusing parts (7) distributed in a dot pattern in correspondence to the shapes of the key tops (4) were printed on the rear surface (3*b*) of the base sheet (3), after which the transparent resin layer (33) 12 μm thick made of an aqueous-based acrylic resin was printed on the entire rear surface (3*b*) of the base sheet (3), which covers the diffusing parts (7). Moreover, the dark print layer (24) 10 μm thick made of a urethane resin including a solvent was formed by being printed on the rear surface of the transparent resin layer (33), and the pushers (8) were provided on the rear surface of the dark print layer (24), forming the key sheet (35). The key sheet (35) was used as sample 3.

As for sample 3, the smooth surface (11) is formed on the rear surface (3*b*) of the base sheet (3), which faces the transparent resin layer (33), and the rough surface (12) is formed on the surface of the transparent resin layer (33) that faces the dark print layer (38). This is because the base sheet (3) made of a polycarbonate resin film was not dissolved during the printing of the transparent resin layer (33) made of an aqueous-based acrylic resin and the transparent resin layer (33) was dissolved during the forming of the dark print layer (38) made of a urethane resin including a solvent by printing.

Sample 4:

As with sample 1, the key tops (4) and the top cover (5) were fixed to the front surface (3*a*) of the base sheet (3) with the bonding layer (10). The diffusing parts (7) distributed in a dot pattern in correspondence to the shapes of the key tops (4) were printed on the rear surface (3*b*) of the base sheet (3), after which the transparent resin layer (37) 12 μm thick made of an acrylic resin including a solvent was printed on the entire rear surface (3*b*) of the base sheet (3), which covers the diffusing parts (7). Moreover, the dark print layer (24) 10 μm thick made of an aqueous-based acrylic resin was formed by being printed on the rear surface of the transparent resin layer (37), and the pushers (8) were provided on the rear surface of the dark print layer (24), forming the key sheet (36). The key sheet was used as sample 4.

As for sample 4, the rough surface (12) is formed on the rear surface (3*b*) of the base sheet (3), which faces the transparent resin layer (37), and the smooth surface (11) is formed on the surface of the transparent resin layer (37) that faces the dark print layer (24). This is because the base sheet (3) made of a polycarbonate resin film was dissolved during the printing of the transparent resin layer (37) made of an acrylic resin including a solvent and the transparent resin layer (37) was not dissolved during the forming of the dark print layer (24) made of an aqueous-based acrylic resin by printing.

Sample 5:

As with sample 1, the key tops (4) and the top cover (5) were fixed to the front surface (3*a*) of the base sheet (3) with the bonding layer (10). The diffusing parts (7) distributed in a dot pattern in correspondence to the shapes of the key tops (4) were printed on the rear surface (3*b*) of the base sheet (3), after which the dark print layer 10 μm thick made of an acrylic resin including a solvent was formed by being printed on the entire rear surface (3*b*) of the base sheet (3), which covers the diffusing parts (7). After that, the pushers (8) were provided on the rear surface of the dark print layer, forming a key sheet. The key sheet was used as sample 5.

As for sample 5, the rough surface (12) is formed on the rear surface (3*b*) of the base sheet (3), which faces the dark print layer. This is because the base sheet (3) made of a polycarbonate resin film was dissolved during the forming of the dark print layer made of an acrylic resin including a solvent by printing.

Sample 6:

As with sample 1, the key tops (4) and the top cover (5) were fixed to the front surface (3*a*) of the base sheet (3) with the bonding layer (10). The diffusing parts (7) distributed in a dot pattern in correspondence to the shapes of the key tops (4) were printed on the rear surface (3*b*) of the base sheet (3), after which the dark print layer 12 μm thick made of an acrylic resin including a solvent was formed by being printed on the entire rear surface (3*b*) of the base sheet (3), which covers the diffusing parts (7). Moreover, the dark print layer 10 μm thick made of a urethane resin including a solvent was printed on the rear surface of the transparent resin layer, and the pushers (8) were provided on the rear surface of the dark print layer, forming a key sheet. The key sheet was used as sample 6.

As for sample 6, the rough surface (12) is formed on the rear surface (3*b*) of the base sheet (3), which faces the transparent resin layer, and the rough surface (12) is formed on the surface of the transparent resin layer that faces the dark print layer. This is because the base sheet (3) made of a polycarbonate resin film was dissolved during the printing of the transparent resin layer made of an acrylic resin including a solvent and the transparent resin layer was also dissolved during the forming of the dark print layer made of a urethane resin including a solvent by printing.

2. Test Method

Each sample was placed on the case (13), the LEDs (16) were caused to emit light, and luminance on the operation surface side of each sample was visually evaluated. The results are shown in Table 1. The luminance evaluation score in each sample was counted with respect to the luminance of a key sheet that lacks the dark print layer (24 or 38), the score of which is 10 points; the score was reduced as the luminance becomes low.

3. Test Results

Samples 1 to 4 had a small decrease in illumination brightness as shown in Table 1. Since samples 1 to 4 each have the smooth surface (11) between the base sheet (3) and the dark print layer (24 or 38), they could make the light transmitting in the base sheet (3) hard to enter the dark print layer (24 or 38) due to the intervention of the smooth surface (11) and could practically avoid light absorption by the dark print layer (24 or 38).

Sample 2, in which the interface between the base sheet (3) and the transparent resin layer (33 or 37) and the interface between the transparent resin layer (33 or 37) and the dark print layer (24 or 38) were both the smooth surface (11), could have higher illumination brightness than samples 3 and 4, in which one of these interfaces was the rough surface (12). In comparison between samples 3 and 4, sample 4 could have a slightly higher illumination brightness.

However, the luminance of samples 5 and 6 was low. A possible reason is that samples 5 and 7 lack the smooth surface (11) between the base sheet (3) and the dark print layer (6) and have the rough surface (12) intervened therebetween, so the light transmitting in the base sheet (3) was absorbed by the dark print layer (6).

"Refractive index and luminance"; Effects of a difference in refractive index on luminance were tested.

1. Manufacturing of Samples:

Sample 7:

The diffusing parts (7) distributed in a dot pattern in correspondence to the shapes of the key tops (4) were printed with a solvent-type printing ink on the rear surface (3*b*) of the base sheet (3) made of a 100-μm-thick urethane resin film with a refractive index of 1.56, after which the 10-μm-thick transparent resin layer (33) with a refractive index of 1.40, made of an ultraviolet-curable acrylic resin was printed on the entire rear surface (3*b*) of the base sheet (3) covering the diffusing parts (7), and the dark print layer (24) made of a urethane resin including a solvent was formed by being printed on the rear surface of the transparent resin layer (33). After that, the pushers (8) were provided on the rear surface of the dark print layer (24). The key tops 4, each having the printed layer (9) on the rear surface, and the top cover (5) were fixed to the front surface (3*a*) of the base sheet (3) with the bonding layer (10), forming the key sheet (35). The key sheet was used as sample 7.

As for sample 7, the smooth surface (11) is formed on the rear surface (3*b*) of the base sheet (3), which faces the transparent resin layer (33), and the rough surface (12) is formed on the surface of the transparent resin layer (33) that faces the dark print layer (38). This is because the base sheet (3) made of a polycarbonate resin film was not dissolved during the printing of the transparent resin layer (33) made of an ultraviolet-curable acrylic resin and the transparent resin layer (33) was dissolved during the forming of the dark print layer (38) made of a urethane resin including a solvent by printing.

Sample 8:

The key sheet (35) was prepared in the same way as for sample 7, except that a 100-μm-thick urethane resin film with a refractive index of 1.51 was used. The key sheet was used as sample 8.

Sample 9:

The key sheet (36) was prepared in the same way as for sample 7, except that the transparent resin layer (37) made of an ultraviolet-curable acrylic resin with a refractive index of 1.50 was printed on the entire rear surface (3*b*) of the base sheet (3) covering the diffusing parts (7). The key sheet was used as sample 9.

Sample 10:

A key sheet was prepared in the same way as for sample 7, except that a 300-μm-thick urethane resin film with a refractive index of 1.51 was used and that the transparent resin layer (37) made of an ultraviolet-curable acrylic resin with a refractive index of 1.50 was printed on the entire rear surface (3*b*) of the base sheet (3) covering the diffusing parts (7). The key sheet was used as sample 10.

Sample 11:

The dark print layer (38) made of a urethane resin including a solvent was formed on the entire rear surface (3*b*) of the base sheet (3) by using a 300-μm-thick urethane resin film with a refractive index of 1.51, without the transparent resin layer (37) being formed. After that, the pushers (8) were provided on the rear surface of the dark print layer (38), forming a key sheet. The key sheet was used as sample 11.

As for sample 11, a rough surface is formed on the rear surface (3*b*) of the base sheet (3), which faces the dark print layer (38). This is because the base sheet (3) made of a polycarbonate resin film was dissolved during the forming of the dark print layer (38) made of a urethane resin including a solvent by printing.

Figure 25:
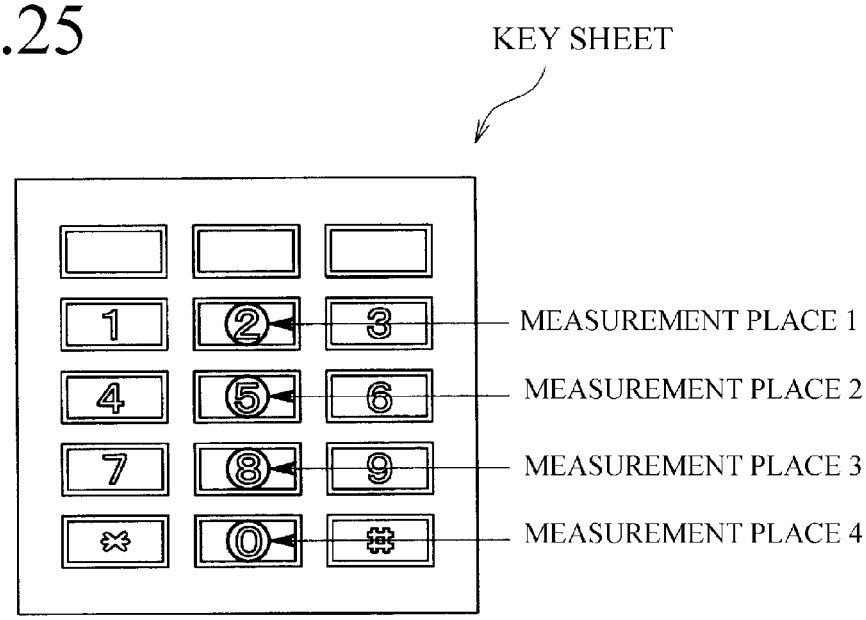
FIG. 25 indicates measurement places on each sample.

2. Test Method:

Each sample was placed on the case (13), the LEDs (16) were caused to emit light, and luminance at four measurement places (see FIG. 25) on the operation surface side of each sample was measured with a luminance meter (LS-110: manufactured by Konica Minolta Holdings, Inc.). The results are shown in Table 2.

3. Test Results

Samples 7 to 9 exhibited higher luminance than samples 10 and 11 as shown in Table 2.

A possible reason is that since samples 7 to 9 had a difference of 0.06 to 0.16 in refractive index between the base sheet (3) and the transparent resin layer (37), light could be reflected on the smooth surface between the base sheet (3) and the transparent resin layer (37) and the light transmitting in the base sheet (3) could be thereby made hard to enter the transparent resin layer (37). Accordingly, even when the interface between the transparent resin layer (37) and the dark print layer (38) was a rough surface, the amount of light incident on the dark print layer (38) could be reduced and light absorption by the dark print layer (38) could be thereby lessened.

Particularly, with samples 7 and 8 having a difference of more than 0.11 in refractive index, since brightness is high, light could be efficiently reflected on the smooth surface between the base sheet (3) and the transparent resin layer (37) and light absorption by the dark print layer (38) could be practically avoided.

As for sample 11, it is thought that since the transparent resin layer (37) was not provided and the interface between the base sheet (3) and the dark print layer (38) was a rough surface, the light transmitting in the base sheet (3) entered the dark print layer (24) through the rough surface and the light transmitting in the base sheet (3) was absorbed by the dark print layer (38). As for sample 10, it is thought that the difference in refractive index between the base sheet (3) and the transparent resin layer (37) was very small, which was 0.01, so although light was reflected on the interface between the base sheet (3) and the transparent resin layer (37), the reflection efficiency was low and most of the light transmitting in the base sheet (3) entered the transparent resin layer (37), after which the light that had entered the transparent resin layer (37) then entered the dark print layer (38) from the rough surface between the transparent resin layer (37) and the dark print layer (38) and was absorbed by the dark print layer (6).

"Flexibility and pressing operability of the base sheet"; Effects of the material of the base sheet on the pressing load were tested.

1. Manufacturing of Samples:

Sample 12:

The diffusing parts (7) distributed in a dot pattern in correspondence to the shapes of the key tops (4) were printed with a solvent-type printing ink on the rear surface (3*b*) of the base sheet (3) made of a 100-μm-thick urethane resin film with a rubber hardness of A50, after which the 10-μm-thick transparent resin layer (33) made of an ultraviolet-curable acrylic resin was printed on the entire rear surface (3*b*) of the base sheet (3) covering the diffusing parts (7), and the dark print layer (24) made of a urethane resin including a solvent was formed by being printed on the rear surface of the transparent resin layer (33). After that, the pushers (8) were provided on the rear surface of the dark print layer (24). The key tops (4), each having the printed layer (9) on the rear surface, and the top cover (5) were fixed to the front surface (3*a*) of the base sheet (3) with the bonding layer (10), forming the key sheet (35). The key sheet was used as sample 12.

As for sample 12, the smooth surface (11) is formed on the rear surface (3*b*) of the base sheet (3), which faces the transparent resin layer (33), and the rough surface (12) is formed on the surface of the transparent resin layer (33) that faces the dark print layer (38).

Sample 13:

The key sheet (35) was prepared in the same way as for sample 12, except that the base sheet (3) made of a 100-μm-thick urethane resin film with a rubber hardness of A90 was used. The key sheet was used as sample 13.

Sample 14:

The key sheet (35) was prepared in the same way as for sample 12, except that the base sheet (3) made of a 100-μm-thick polycarbonate resin film with a Rockwell hardness of HRR 107 (the rubber hardness is higher than A90 and the hardness cannot be measured as rubber hardness) was used. The key sheet was used as sample 14.

Sample 15:

A key sheet was prepared by bonding key tops to a base rubber with pushers rather than a base sheet for a light-guiding sheet, the base rubber being made of 50-μm-thick silicone rubber with a rubber hardness of A50, which is used as a normal key sheet. The key sheet was used as sample 14.

2. Test Method

Figure 26:
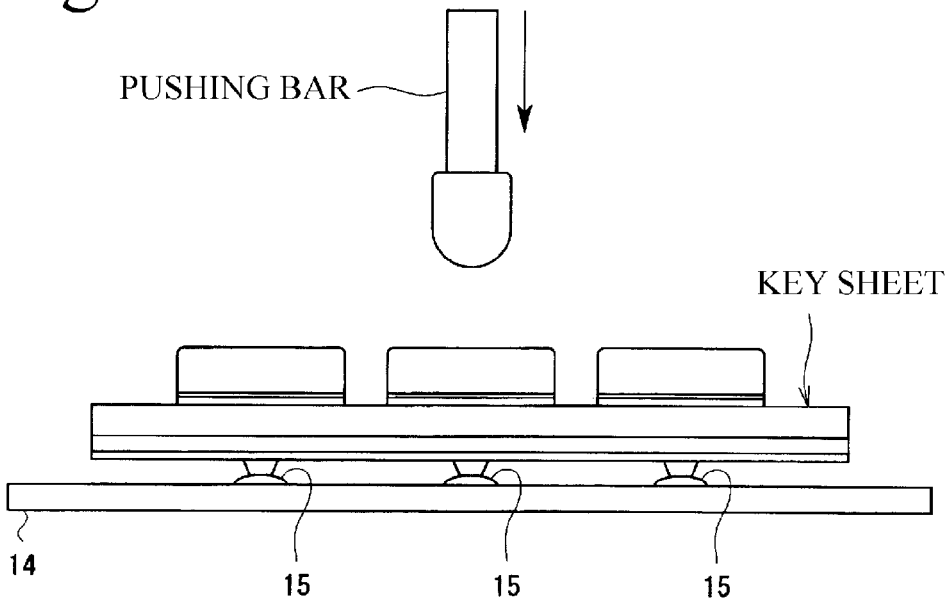
FIG. 26 illustrates a pressing test method for each sample.

A push-button switch structure as shown in FIG. 26 was prepared by using the key sheets of samples 12 to 15, and load-stroke characteristics were measured by pressing the samples with a pushing bar. The results were shown in Table 3. A pressing load curve in the measurement results is a curve as shown in FIG. 27. The load at the first peak (S1) of the curve is referred to as the maximum load (F1). Then, as the stroke is prolonged, the load is lowered and reaches a point (S2) at which the relevant contact is turned on. The load at that point is defined as the ON load (F2). The click ratio is defined by equation 1.

$$\text{Click ratio (\%)}=(F1-F2)/F1 \quad \text{(equation 1)}$$

3. Test Results

Better pressing operability generally indicates that the maximum load is low and the click ratio is high.

In comparison with sample 15, which is a normal key sheet lacking a base sheet used as a light-guiding sheet, an increase in the pressing load applied to samples 12 and 13 was low, 5% or less. With sample 14 in which a hard base sheet was used, an increase in the pressing load was 10% or more. A decrease in the click ratio of samples 12 and 13 was also 5% or less, and the pressing operation feeling was almost the same as with a normal key sheet. A decrease in the click ratio of sample 14 was as high as 25%, and the pressing operation feeling was worsened.

"Material of the dark print layer and light leakage"; Effects of the material of the dark print layer on light leakage were tested.

1. Manufacturing of Samples:

Sample 16:

The diffusing parts (7) distributed in a dot pattern in correspondence to the shapes of the key tops (4) were printed with a solvent-type printing ink on the rear surface (3*b*) of the base sheet (3) made of a 100-μm-thick polycarbonate resin film, after which the 15-μm-thick dark print layer (24) made of a water-soluble acrylic resin was formed on the entire rear surface (3*b*) of the base sheet (3) covering the diffusing parts (7). After that, the pushers (8) were provided on the rear surface of the dark print layer (24). The key tops (4), each having the printed layer (9) on the rear surface, and the top cover (5) were fixed to the front surface (3*a*) of the base sheet (3) with the bonding layer (10), forming the key sheet (1). The key sheet was used as sample 16.

As for sample 16, the smooth surface is formed on the rear surface of the base sheet (3), which faces the dark print layer.

Sample 17:

The key sheet (1) was prepared in the same way as for sample 16, except that the dark print layer (24) was formed by printing a 30-μm-thick coating made of an ultraviolet-curable resin (UIM, manufactured by Jujo Chemical Co., Ltd.) and then curing the coating under the conditions that illumination was about 500 mW/cm$^2$ and the integral amount of light was about 2000 mJ/cm$^2$. The key sheet was used as sample 17.

Sample 18:

The key sheet (1) was prepared in the same way as for sample 16, except that the dark print layer (24) 40 μm thick was formed by printing from an ultraviolet-curable resin (UIM, manufactured by Jujo Chemical Co., Ltd.). The key sheet was used as sample 18.

2. Test Method

It was checked whether light leakage could be visually recognized in a dark room when the key sheets of samples 16 to 18 were illuminated. For the ultraviolet-curable resin, the ease with which the coating was cured was also checked. The results are shown in Table 4.

3. Test Results

For samples 16 and 18, light leakage could not be recognized. For sample 17, light leakage could be recognized. As for the ease with which the coating was cured, sample 17 was cured, but sample 18 was cured only on the surface of the dark print layer to which ultraviolet was directed and was not cured on the rear surface fixed to the base sheet. Sample 18 appeared to be cured and contracted only at a part where the coating surface was cured, and had a pattern like wrinkles on the surface of the dark print layer.

TABLE 3

| | Base sheet | | Maximum load (N) (The value in parentheses is a rate of change from | Click ratio (%) (The value in parentheses is a rate of change from |
|---|---|---|---|---|
| | Material | Hardness | sample 15.) | sample 15.) |
| Sample 12 | Urethane resin | A50 | 1.95 (+1%) | 1.85 (−1%) |
| Sample 13 | Urethane resin | A90 | 2.02 (+5%) | 17.9 (−4%) |
| Sample 14 | Polycarbonate resin | (>A90) | 2.17 (+12%) | 14.0 (−25%) |
| Sample 15 | — | A50 | 1.93 | 18.6 |

TABLE 4

| | Dark print layer | | |
|---|---|---|---|
| | Material | Film thickness (μm) | Light leakage |
| Sample 16 | Water-soluble acrylic resin | 15 | No |
| Sample 17 | Ultraviolet-curable resin | 30 | Yes |
| Sample 18 | Ultraviolet-curable resin | 40 | No |

INDUSTRIAL APPLICABILITY

The present invention relates to a key sheet for a push-button switch used to supply inputs to mobile information terminals such as mobile phones, PDAs, and mobile music players and to various types of electronic devices such as AV devices, and also relates to a lightproof light guiding sheet used in the key sheet, a push-button switch having the key sheet, and the method of manufacturing the key sheet, so the present invention can be used in the information communication device industry, the consumer electronics industry, and their related industries.

TABLE 1

| | Sample 1 | Sample 2 | Sample 3 | Sample 4 | Sample 5 | Sample 6 |
|---|---|---|---|---|---|---|
| Surface of base sheet that faces dark print layer | Smooth surface | — | — | — | Rough surface | — |
| Surface of base sheet that faces transparent resin layer | — | Smooth surface | Smooth surface | Rough surface | — | Rough surface |
| Surface of transparent resin layer that faces dark print layer | — | Smooth surface | Rough surface | Smooth surface | — | Rough surface |
| Luminance evaluation score | 4 | 9 | 6 | 7 | 1 | 2 |

TABLE 2

| | Refractive index | | | Brightness at each measurement point cd/m$^2$ | | | | |
|---|---|---|---|---|---|---|---|---|
| | Base sheet | Transparent resin layer | Difference in refractive index | 1 | 2 | 3 | 4 | Average |
| Sample 7 | 1.56 | 1.40 | 0.16 | 2.1 | 0.9 | 1.1 | 2.2 | 1.58 |
| Sample 8 | 1.51 | 1.40 | 0.11 | 2.0 | 0.7 | 0.9 | 2.2 | 1.45 |
| Sample 9 | 1.56 | 1.50 | 0.06 | 0.6 | 0.5 | 0.4 | 1.4 | 0.73 |
| Sample 10 | 1.51 | 1.50 | 0.01 | 0.1 | 0.1 | 0.1 | 0.3 | 0.15 |
| Sample 11 | 1.51 | None | — | 0.1 | 0.0 | 0.0 | 0.1 | 0.08 |

The invention claimed is:

1. A key sheet that includes a base sheet formed of a transparent resin film and a depressing operation portion formed on an operation surface side of the base sheet, the key sheet being illuminatable, wherein:

the base sheet is a light-guiding sheet; and a transparent resin layer is formed on a rear surface of the base sheet, the rear surface being opposite from the operation surface side, the transparent resin layer being made of a cured body of a coating liquid that does not dissolve to the surface of the base sheet, a dark print layer, which shields light, is further formed on a surface of the transparent resin layer, a smooth surface is provided between the base sheet and the dark print layer, and a diffusing part which includes a filling material is formed on the rear surface of the base sheet to direct light transmitting in a surface direction of the base sheet to the depressing operation portion, the diffusing part being formed on a front surface side of the dark print layer, the front surface side being facing the base sheet.

2. The key sheet according to claim 1, wherein a difference in refractive index between the transparent resin layer and the base sheet is 0.06 or more.

3. The key sheet according to claim 1, wherein the base sheet has rubber elasticity equivalent to a rubber hardness of A50 to A90 stipulated in JIS K6253.

4. The key sheet according to claim 1, wherein the dark print layer is made of a cured body of a coating liquid that is not dissolve to the surface of the transparent resin layer.

5. The key sheet according to claim 1, wherein a surface of the transparent resin layer that faces the base sheet is a smooth surface.

6. The key sheet according to claim 1, wherein the transparent resin layer is disposed over an entire surface of at least one side of the base sheet.

7. The key sheet according to claim 1, wherein a pusher is formed on a surface of the dark print layer that is disposed opposite to the depressing operation portion with the base sheet intervening therebetween.

8. The key sheet according to claim 7, wherein the dark print layer is provided between the base sheet and the pusher.

9. The key sheet according to claim 1, wherein a surface of the base sheet that face the diffusing part is made rough, and the diffusing part is covered by the transparent resin layer.

10. A lightproof light guiding sheet, wherein a transparent resin layer is formed on a rear surface of the base sheet, the rear surface being opposite from the operation surface side, the transparent resin layer being made of a cured body of a coating liquid that does not dissolve to the surface of the base sheet, a dark print layer, which shields light, is further formed on a surface of the transparent resin layer, a smooth surface is provided between the base sheet and the dark print layer, a diffusing part which includes a filling material is formed on the rear surface of the base sheet to direct light transmitting in a surface direction of the base sheet to the depressing operation portion, the diffusing part being formed on a front surface side of the dark print layer, the front surface side being facing the base sheet.

11. The lightproof light guiding sheet according to claim 10, wherein a difference in refractive index between the transparent resin layer and the light-guiding sheet is 0.06 or more.

12. The lightproof light guiding sheet according to claim 10, wherein the light-guiding sheet has rubber elasticity equivalent to a rubber hardness of A50 to A90 stipulated in JIS K6253.

13. A method of manufacturing an illuminatable key sheet that includes a base sheet formed of a transparent resin film and a depressing operation portion formed on an operation surface side of the base sheet, wherein:

the base sheet is a light-guiding sheet; and the key sheet is manufactured by applying a coating liquid that is not dissolve to the surface of the base sheet to a surface of at least one side of the base sheet and curing the coating liquid to form a transparent resin layer thereon, and by further forming a dark print layer, which shields light, on a surface of the transparent resin layer by printing, the key sheet having a smooth surface between the base sheet and the dark print layer.

14. A key sheet that includes a key top, a base sheet, which is a light-guiding sheet used as a path through which light used to illuminate the key top passes, the key top being mounted on the base sheet, and a dark print layer, formed on a rear surface of the base sheet, the rear surface being opposite from the operation surface side, which prevents light from leaking in a thickness direction of the base sheet, the dark print layer being made of any one of a non-solvent urethane-based ink, an aqueous-based or alcohol-based curable ink, an EB-curable ink, and an ultraviolet-curable ink, wherein:

the base sheet is formed from a transparent resin film, an interface between the resin film and the dark print layer is formed as a smooth surface that prevents light transmitting in the base sheet in a surface direction of the base sheet from entering the dark print layer, and a diffusing part which includes a filling material is formed on the rear surface of the base sheet to direct light transmitting in a surface direction of the base sheet to the depressing operation portion, the diffusing part being formed on a front surface side of the dark print layer, the front surface side being facing the base sheet.

15. The key sheet according to claim 14, wherein the base sheet has rubber elasticity.

16. The key sheet according to claim 14, wherein the base sheet has rubber elasticity equivalent to a rubber hardness of A50 to A90 stipulated in JIS K6253.

17. The key sheet according to claim 14, wherein a diffusing part is formed on a surface of at least one side of the base sheet to direct light transmitting in a surface direction of the base sheet to the depressing operation portion.

18. The key sheet according to claim 14, wherein a pusher is formed on a surface of the dark print layer that is disposed opposite to the key top with the base sheet intervening therebetween.

19. The key sheet according to claim 18, wherein the dark print layer is provided between the base sheet and the pusher.

20. A method of manufacturing an illuminatable key sheet that includes a key top, a base sheet, which is a light-guiding sheet used as a path through which light used to illuminate the key top passes, the key top being mounted on the base sheet, and a dark print layer, formed on a surface of at least one side of the base sheet, which prevents light from leaking in a thickness direction of the base sheet, wherein:

the key sheet has a dark print layer, which shields light, on a surface of at least one side of a base sheet formed of a transparent resin film by applying any one of a non-solvent urethane-based ink, an aqueous-based or alcohol-based curable ink, an EB-curable ink, and an ultraviolet-curable ink, which are coating liquids that are not dissolve to the surface of the base sheet, to the surface and curing the ink; the key sheet also has an interface between the resin film and the dark print layer as a smooth surface that prevents light transmitting in the base sheet in a surface direction of the base sheet from entering the dark print layer.

* * * * *